US008374522B2

(12) United States Patent
Nonaka

(10) Patent No.: US 8,374,522 B2
(45) Date of Patent: Feb. 12, 2013

(54) PRINTING APPARATUS AND PRINTING METHOD

(75) Inventor: Takashi Nonaka, Kunitachi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/333,905

(22) Filed: Dec. 21, 2011

(65) Prior Publication Data

US 2012/0093535 A1 Apr. 19, 2012

Related U.S. Application Data

(63) Continuation of application No. 11/742,784, filed on May 1, 2007, now Pat. No. 8,107,845.

(30) Foreign Application Priority Data

May 11, 2006 (JP) ..... 2006-132383

(51) Int. Cl.
*G03G 15/00* (2006.01)
*G03G 15/01* (2006.01)

(52) U.S. Cl. ..... 399/82; 399/81

(58) Field of Classification Search ..... 399/82, 399/85

See application file for complete search history.

(56) References Cited

U.S. PATENT DOCUMENTS 7,664,420 B2 * 2/2010 Oominami et al. ..... 399/85
2004/0190926 A1 * 9/2004 Burkes et al. ..... 399/82

FOREIGN PATENT DOCUMENTS

JP 2002-139878 A 5/2002
JP 2003-054080 A 2/2003
JP 2004-030169 A 1/2004

* cited by examiner

*Primary Examiner* — Sophia S Chen
(74) *Attorney, Agent, or Firm* — Canon U.S.A., Inc. IP Division

(57) ABSTRACT

A printing apparatus performs print processing on a plurality of sheets according to print data input by an input unit, and sets the printing unit to a first operation state in which monochromatic print processing is capable of being performed or to a second operation state in which color print processing is capable of being performed. The printing apparatus enables selection between a first print mode and a second print mode. In the first print mode, a sheet is conveyed at a defined speed in the monochromatic print processing and is conveyed at a speed lower than the defined speed in the color print processing. In the second print mode, a sheet is conveyed at a speed lower than the defined speed both in the monochromatic print processing and in the color print processing.

16 Claims, 18 Drawing Sheets

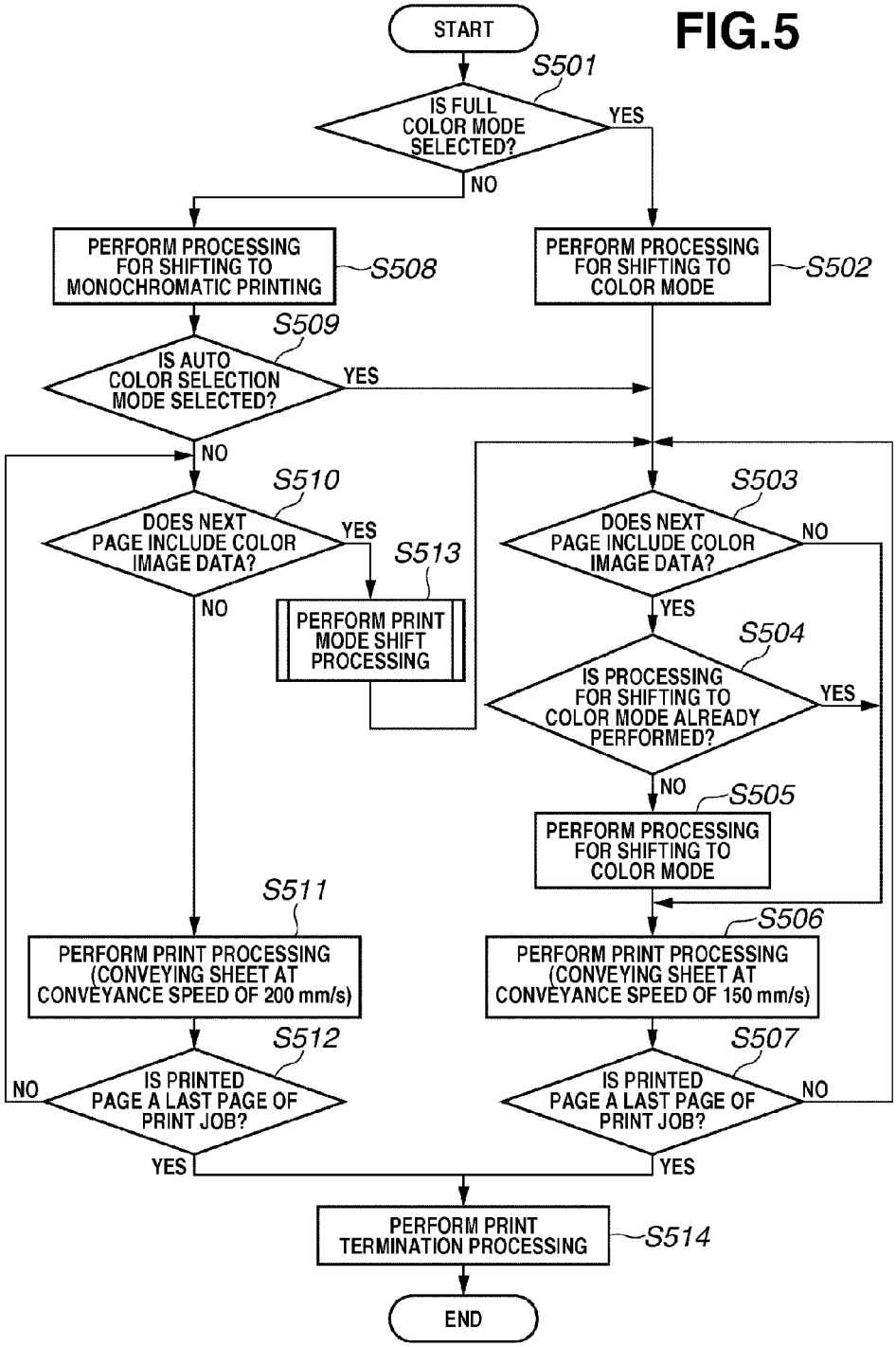
FIG.5
START
S501
IS FULL COLOR MODE SELECTED?
YES
NO
PERFORM PROCESSING FOR SHIFTING TO MONOCHROMATIC PRINTING
S508
PERFORM PROCESSING FOR SHIFTING TO COLOR MODE
S502
S509
IS AUTO COLOR SELECTION MODE SELECTED?
YES
NO
S510
DOES NEXT PAGE INCLUDE COLOR IMAGE DATA?
YES
NO
S513
PERFORM PRINT MODE SHIFT PROCESSING
S503
DOES NEXT PAGE INCLUDE COLOR IMAGE DATA?
NO
YES
S504
IS PROCESSING FOR SHIFTING TO COLOR MODE ALREADY PERFORMED?
YES
NO
S505
PERFORM PROCESSING FOR SHIFTING TO COLOR MODE
S511
PERFORM PRINT PROCESSING (CONVEYING SHEET AT CONVEYANCE SPEED OF 200 mm/s)
S506
PERFORM PRINT PROCESSING (CONVEYING SHEET AT CONVEYANCE SPEED OF 150 mm/s)
S512
IS PRINTED PAGE A LAST PAGE OF PRINT JOB?
NO
YES
S507
IS PRINTED PAGE A LAST PAGE OF PRINT JOB?
NO
YES
PERFORM PRINT TERMINATION PROCESSING
S514
END

PRINTING APPARATUS AND PRINTING METHOD

CROSS-REFERENCE TO RELATED APPLICATIONS

This application claims priority from U.S. application Ser. No. 11/742,784 filed May 1, 2007 and Japanese Patent Application No. 2006-132383 filed May 11, 2006, which are hereby incorporated by reference herein in their entireties.

BACKGROUND OF THE INVENTION

1. Field of the Invention

The present invention relates to a printing apparatus and a printing method.

2. Description of the Related Art

A conventional printing apparatus performs printing in a monochromatic print mode when a print page includes monochromatic image data, and in a color print mode when a print page includes color image data. As a conventional printing method used in a printing apparatus, an electrophotographic system and an inkjet printing system are known.

For example, in an electrophotographic printing apparatus, in a monochromatic print mode, a toner image of a single color (for example, black) is transferred onto a sheet before pressure and heat are applied to the sheet, and the toner image is fixed on the sheet. On the other hand, in a color print mode, toner images of plural colors (for example, four colors of yellow, cyan, magenta, and black) are fixed on a sheet. In a color print mode, toner images of plural colors are fixed on a sheet overlapping with one another. Accordingly, in the color print mode, it is necessary to apply sufficient heat to a sheet at a sheet conveyance speed which is lower than a sheet conveyance speed of the monochromatic print mode.

As described above, in a printing apparatus, sheet conveyance speeds are different between a monochromatic print mode and a color print mode. In such a type of printing apparatus, the following problem arises in performing a print job including both monochromatic image data and color image data. That is, when both monochromatic image data and color image data are present, a print mode needs to be changed during print processing. Thus, additional time is consumed to execute a print mode changing operation. Accordingly, printing efficiency is lowered.

In order to solve this problem, Japanese Patent Application Laid-Open No. 10-63450 discusses a method which selects print modes. When a print job including both monochromatic image data and color image data is performed, it is determined which print mode is better to be selected in terms of printing efficiency.

The method discussed in Japanese Patent Application Laid-Open No. 10-63450 has the following problems.

In the method used for a printing apparatus discussed in Japanese Patent Application Laid-Open No. 10-63450, a print mode is selected considering in advance whether image data is color or monochromatic as to all pages when image data for plural pages are printed. Consequently, in this method, print processing cannot be started before determining whether image data is color or monochromatic for all pages.

In another conventional method, a print mode can be selected without determining whether image data is color or monochromatic for all pages, in order to quickly start print processing. In such a method, when a color print mode is selected, processing for shifting to color printing is performed to change a printing apparatus to a state in which color printing can be performed. In the processing for shifting to color printing, it generally takes longer time than processing for shifting to monochromatic printing that is performed to shift a printing apparatus to a state in which monochromatic printing can be performed when a monochromatic print mode is selected.

However, when a color print mode is selected, it cannot be previously determined whether a print job includes color image data. Accordingly, a print job can be completed without print processing of color image data although a color print mode is selected.

In such a case, processing for shifting to color printing is performed even on a print job that does not include color image data. As a result, the shifting to color printing is uselessly performed and causes a waste of time.

SUMMARY OF THE INVENTION

According to an aspect of the present invention, a printing apparatus includes: an input unit configured to input print data; a printing unit configured to perform print processing on a plurality of sheets according to the print data input by the input unit; a setting unit configured to set the printing unit to a first operation state in which monochromatic print processing is capable of being performed or to a second operation state in which color print processing is capable of being performed; a selection unit configured to select between a first print mode in which a sheet is conveyed at a defined speed in the monochromatic print processing and is conveyed at a speed lower than the defined speed in the color print processing and a second print mode in which a sheet is conveyed at a speed lower than the defined speed both in the monochromatic print processing and in the color print processing; and a control unit configured to control the printing unit to perform print processing according to the print mode selected by the selection unit. In the printing apparatus, the setting unit is configured to set the printing unit to the first operation state in starting the print processing, in both cases where the first print mode is selected or where the second print mode is selected.

Further features and aspects of the present invention will become apparent from the following detailed description of exemplary embodiments with reference to the attached drawings.

BRIEF DESCRIPTION OF THE DRAWINGS

The accompanying drawings, which incorporate and constitute a part of the specification, illustrate exemplary embodiments, features, and aspects of the invention and, together with the description, serve to explain the principle of the invention.

FIG. 5 is a flow chart illustrating print processing performed by the printing apparatus according to the exemplary embodiment of the present invention.

DETAILED DESCRIPTION OF THE EXEMPLARY EMBODIMENTS

Various exemplary embodiments, features and aspects of the present invention will now herein be described in detail with reference to the drawings. It is noted that the relative arrangement of the components, the numerical expressions, and numerical values set forth in these embodiments are not intended to limit the scope of the present invention unless it is specifically stated otherwise.

First Exemplary Embodiment

Figure 1:
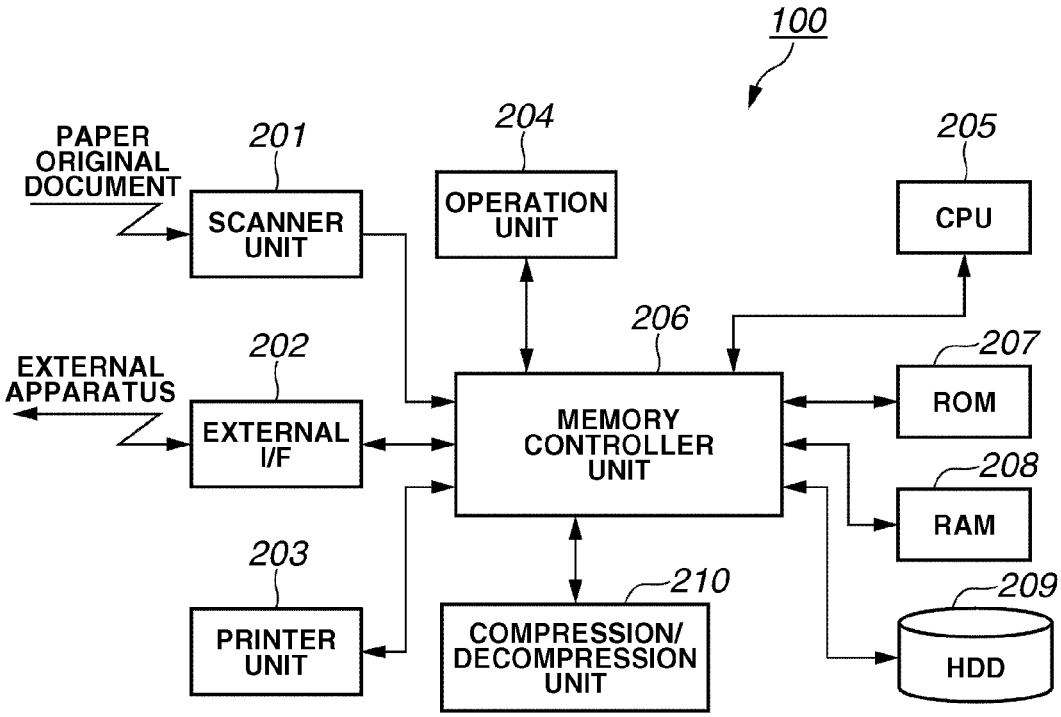
FIG. 1 illustrates a control configuration of a printing apparatus according to an exemplary embodiment of the present invention.

Now, a first exemplary embodiment of the present invention is described below. FIG. 1 illustrates control performed by a printing apparatus 100 according to an exemplary embodiment of the present invention.

Referring to FIG. 1, the printing apparatus 100 includes a scanner unit 201. The scanner unit 201 optically reads a plurality of original documents (e.g., paper sheet documents on which images are printed) to generate image data and performs image processing (e.g., shading correction) to the read image data.

The scanner unit 201 according to the first exemplary embodiment can read an original document as color image data. More specifically, the scanner unit 201 can read an original document as image data in three colors of red, green and blue (RGB).

A central processing unit (CPU) 205, which will be described below, converts image data of RGB three colors read by the scanner unit 201 into image data of CYMK four colors of cyan, magenta, yellow, and black (CMYK). Thus, a printer unit 203 can print a color image.

The scanner unit 201 stores the image data of the plural pages to which image processing is performed, into a hard disk (HDD) 209 as one print job. The printing apparatus 100 includes an external interface (I/F) 202. The external I/F 202 receives a print job including image data of the plural pages from an external apparatus connected to the printing apparatus 100 via a network. The external I/F 202 stores the received print job into the HDD 209.

The printing apparatus 100 includes the printer unit 203. The printer unit 203 performs print processing to a plurality of sheets S according to the print job stored in the HDD 209. The print job includes image data of plural pages. Accordingly, a plurality of image data is printed onto each of the plural sheets. An operation unit 204 receives various kinds of instructions generated by an operator of the printing apparatus 100 and transmits the received instructions to a memory controller unit 206 to perform various settings on the printing apparatus 100.

The CPU 205 writes a program read from a read only memory (ROM) 207 to a random access memory (RAM) 208 and executes the program using RAM 208. Thus, the CPU 205 controls the entire printing apparatus 100. The ROM 207 stores a program for interpreting page description language (PDL) code data, which the external I/F 202 receives from an external apparatus as a print job.

Furthermore, the ROM 207 stores a program for generating data that can be printed by the printer unit 203 after the PDL code data is interpreted. The memory controller unit 206 controls an access from each unit and apparatus to the ROM 207, the RAM 208, and the HDD 209.

A compression/decompression unit 210 can perform compression processing to image data stored in the RAM 208 and the HDD 209 utilizing a compression method such as Joint Bi-level Image Experts Group (JBIG) and Joint Photographic Experts Group (JPEG). Moreover, the compression/decompression unit 210 can decompress image data compressed in various compression methods.

Figure 2:
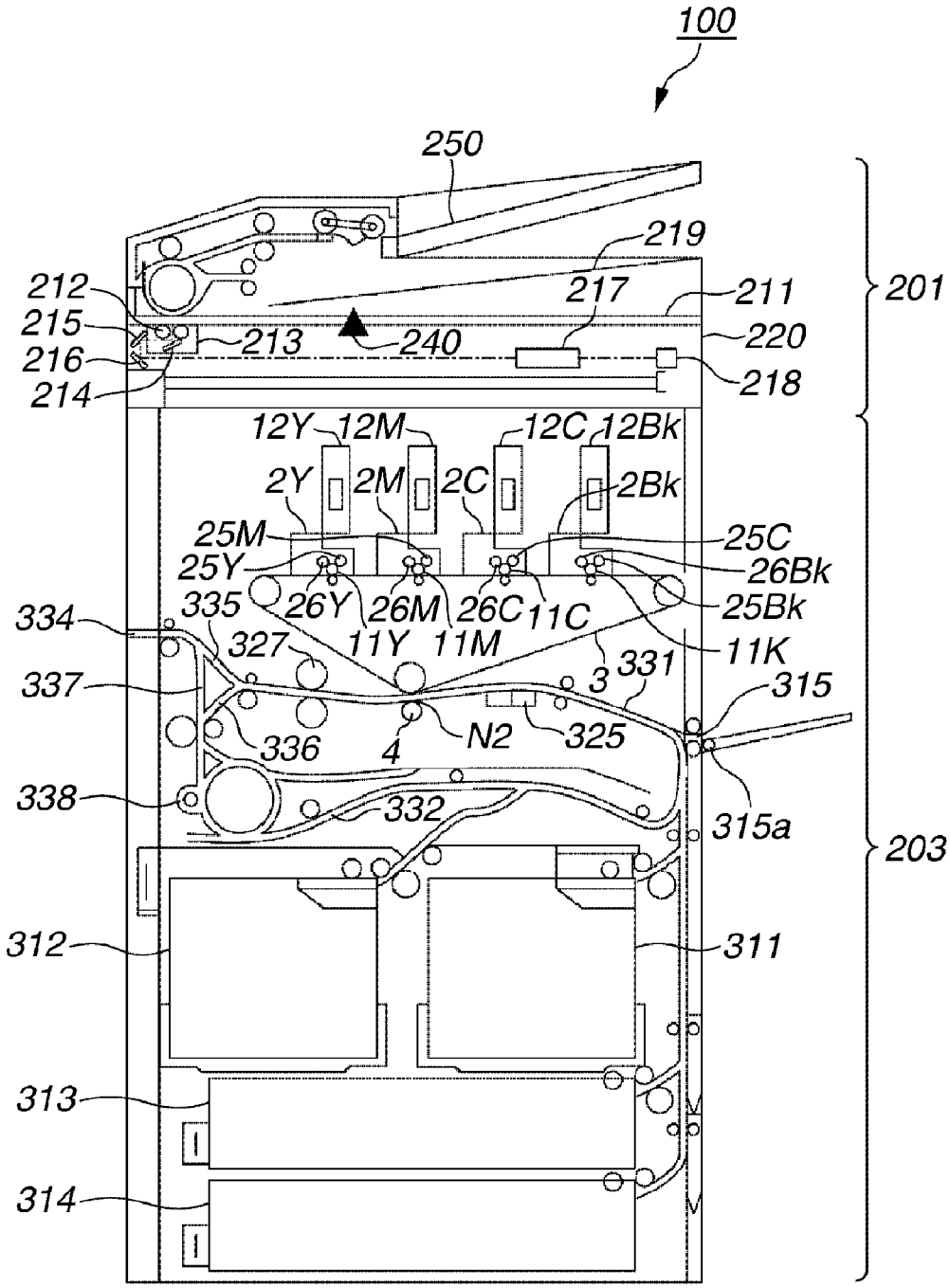
FIG. 2 illustrates a hardware configuration of the printing apparatus according to the exemplary embodiment of the present invention.

An exemplary hardware configuration of the printing apparatus 100 is described below with reference to FIG. 2.

The printing apparatus 100 mainly includes the scanner unit 201 and the printer unit 203. The scanner unit 201 feeds a sheet from a sheet bundle in an original document feed unit 250, from top to bottom in order of stacking, sheet by sheet onto a platen glass 211.

After the original document is read by a scanner unit 220, the original document feed unit 250 discharges the original document onto a discharge tray 219. When an original document sheet is fed onto the platen glass 211, the scanner unit 220 activates the lamp 212 and starts moving an optical unit 213 to scan the sheet-like original document by irradiating from below.

Light reflected from the original document is guided to a charge-coupled device (CCD) image sensor (hereinafter simply referred to as a "CCD") 218 via a plurality of mirrors 214, 215, and 216 and a lens 217. Images on the original document are scanned and read as image data by the CCD 218. The image data read by the CCD 218 is subjected to predetermined image processing, and subsequently, stored in the HDD 209.

The printing apparatus 100 transfers toner images of a plurality of colors (yellow, cyan, magenta, and black) onto a print sheet, and then the influence of heat fixes the toner images on the print sheet to perform print processing. The printing apparatus 100 includes a plurality of printing units (a printing unit 2Y, a printing unit 2M, a printing unit 2C, and a printing unit 2Bk) that primarily transfers the each toner image of the plural colors onto an intermediate transfer belt 3.

The printing apparatus 100 includes the intermediate transfer belt 3 to which the toner images carried to the printing units 2Y, 2M, 2C, and 2Bk are primarily transferred overlapping with one another. Furthermore, the printing apparatus 100 includes a secondary transfer roller 4 that secondarily transfers the toner images primarily transferred onto the intermediate transfer belt 3 overlapping with one another, onto the sheet S at a secondary transfer position N2.

The printing units 2Y, 2M, 2C, and 2Bk each include a photosensitive drum 11Y, 11M, 11C, and 11Bk. The photosensitive drums 11Y, 11M, 11C, and 11Bk each include a charging unit 25Y, 25M, 25C, and 25Bk. The printing units 2Y, 2M, 2C, and 2Bk each include a laser scanning unit 12Y, 12M, 12C, and 12Bk. The photosensitive drums 11Y, 11M, 11C, and 11Bk are charged at a uniform potential by a charging roller 25. The laser scanning units 12Y, 12M, 12C, and 12Bk irradiates the photosensitive drums 11Y, 11M, 11C, and 11Bk with a laser beam according to an image signal, so as to form an electrostatic latent image.

In addition, the printing units 2Y, 2M, 2C, and 2Bk each include a development unit 26Y, 26M, 26C, and 26Bk that develop the electrostatic latent image formed on the photosensitive drums 11 with the toners.

Meanwhile, at timing synchronized with start of irradiation with the laser beam, a sheet S is fed from one of cassettes 311, 312, 313, and 314, and a manual feed tray 315. Then, the fed sheet S is conveyed to a transfer unit 325 via a conveyance path 331. The manual feed tray 315 includes a sheet detection sensor 315*a*, which detects that a sheet S is placed on the manual feed tray 315.

The secondary transfer roller 4 transfers a toner image adhering to the intermediate transfer belt 3 (developer image) onto the sheet S. The sheet S onto which the toner image is transferred is conveyed to a fixing unit 327, and heated by the fixing unit 327. Thus, the toner image on the sheet S is fixed onto the sheet S.

The sheet S, onto which the toner image is fixed, is discharged onto a discharge tray (not shown) outside the printing apparatus 100 via conveyance paths 335 and 334. In a case where the sheet S is reversed and then conveyed to the discharge tray, the CPU 205 controls the printer unit 203 so that the sheet S is guided to conveyance paths 336 and 338. Subsequently, the sheet S is conveyed in a reverse direction and is discharged to the outside of the printing apparatus 100 via conveyance paths 337 and 334.

Figure 3:
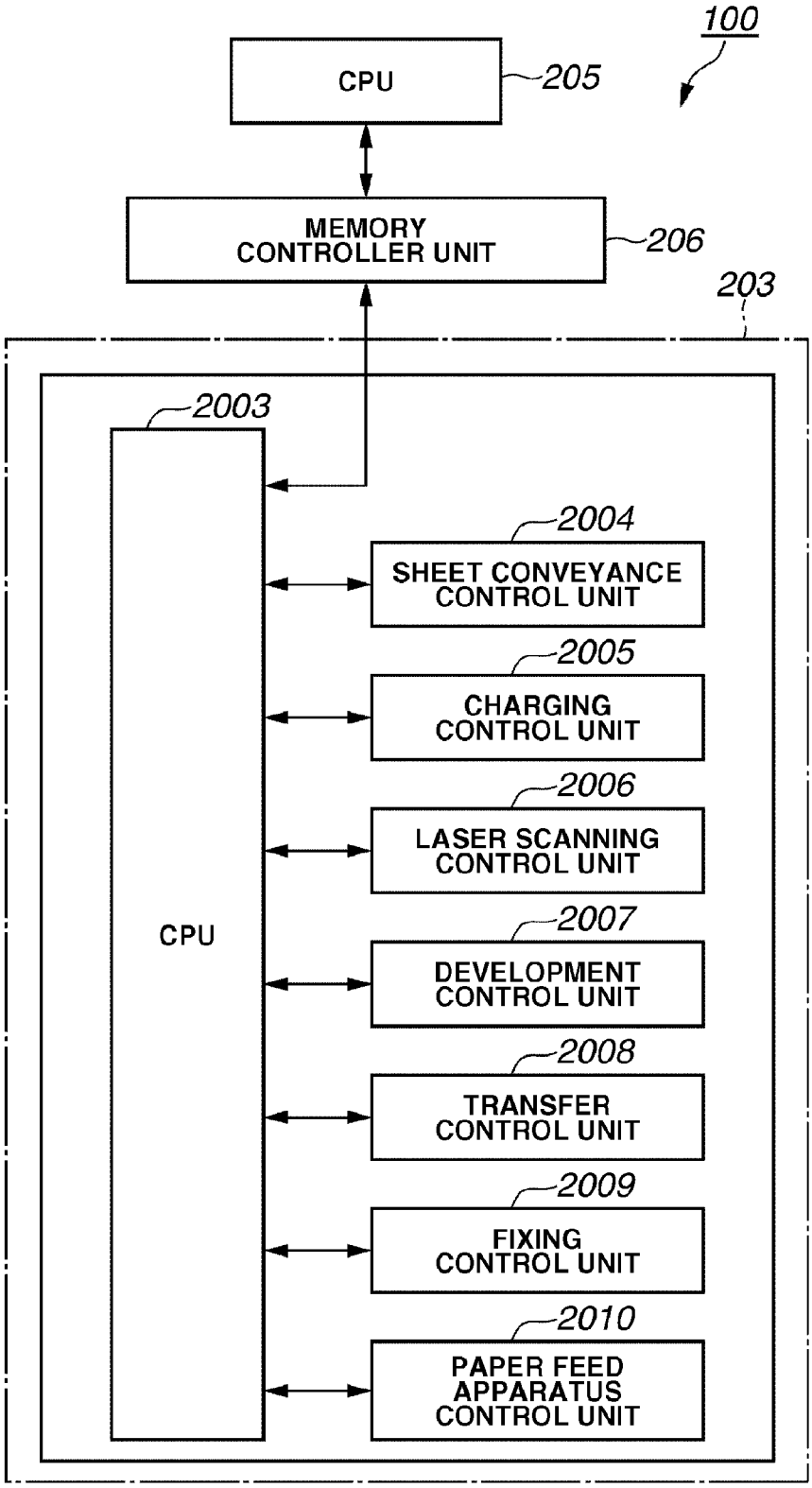
FIG. 3 illustrates a control configuration of the printing apparatus according to the exemplary embodiment of the present invention.

Now, a control configuration of a full color printing apparatus according to the first exemplary embodiment is described below with reference to FIG. 3.

The printer unit 203 included in the printing apparatus 100 can mutually communicate with the CPU 205 via the memory controller unit 206. A CPU 2003 of the printer unit 203 receives image data and a command for performing print processing from the memory controller unit 206. Then, the CPU 2003 processes the received image data and converts the image data into bitmap data, and processes the received command.

The printer unit 203 includes various control units controlled by the CPU 2003. The various control units include a sheet conveyance control unit 2004 for controlling various rollers included in the printing apparatus 100 to convey a sheet S and a charging control unit 2005 for controlling voltage applied to the charging roller 25 to charge the photosensitive drums 11 at a predetermined potential.

In addition, the printer unit 203 includes a laser scanning control unit 2006. The laser scanning control unit 206 controls scanning of laser that exposes a surface of the photosensitive drum 11 according to the image data that the printer unit 203 receives from the memory controller unit 206. Furthermore, the printer unit 203 includes a development control unit 2007. The development control unit 207 controls a development device 26 to develop the electrostatic latent image formed on the surface of the photosensitive drum 11.

Moreover, the printer unit 203 includes a transfer control unit 208. The transfer control unit 2008 controls a transfer voltage applied to the secondary transfer roller 4 to transfer the toner image formed on the intermediate transfer belt 3 onto the sheet S. Further, the printer unit 203 includes a fixing control unit 2009. The fixing control unit 2009 controls rotation of a roller pair constituting the fixing unit 327, and the power supplied to a heater to fix the toner image on the sheet S onto which the toner image is secondarily transferred. At least one of the pair rollers includes the heater.

In addition, the printer unit 203 includes a paper feed apparatus control unit 2010. The paper feed apparatus control unit 2010 controls driving of rollers included in the cassettes 311, 312, 313, and 314 to feed the sheet S to the printing units 2.

Now, print processing performed by the printing unit 2 is described below. In the present exemplary embodiment, the print processing performed by the printing unit 2 includes three different print processing modes. Hereinbelow, each print mode is described.

(1) Monochromatic Mode

A monochromatic mode is suitable in printing monochromatic image data. In an embodiment, in the monochromatic mode, a sheet is conveyed at a speed of 200 mm/s to perform print-processing. The CPU 205, when a high speed monochromatic print mode is selected as the print mode, sends a command to perform processing for shifting to monochromatic printing, to the printer unit 203.

The processing for shifting to monochromatic printing shifts the printing unit 2Bk of the plurality of printing units (printing units 2Y, 2M, 2C, and 2Bk) to an operation state. More specifically, the CPU 205 sends to the CPU 2003 of the printer unit 203, a command to apply voltage to the charging roller 25Bk, a command to apply voltage to a development roller (not shown) of the development device 26Bk, and a command to apply voltage to the secondary transfer roller 4.

After receiving the command from the CPU 205, the CPU 2003 starts applying voltage to the charging roller 25Bk via the charging control unit 2005.

Further, the CPU 2003 starts applying voltage to the development roller via the development control unit 2007, and starts applying voltage to the secondary transfer roller 4 via the transfer control unit 2008. When the CPU 2003 determines that the printing unit 2Bk has shifted to an operation state after applying voltage to the development roller and the secondary transfer roller 4, the CPU 2003 notifies the CPU 205 that the printing unit 2Bk has shifted to its operation state.

When the CPU 205 receives the notification that the printing unit 2Bk has shifted to the operation state, the CPU 205 sends to the CPU 2003 a command for conveying a sheet at a speed of 200 mm/s so that monochromatic print processing starts using the printing unit 2Bk. When the CPU 2003 receives the command from the CPU 205, the CPU 2003 controls a rotation speed of various rollers included in the printing apparatus 100 to convey the sheet at the conveyance speed of 200 mm/s.

(2) Full Color Mode

A full color mode is suitable in printing color image data. In an embodiment, in the full color mode, a sheet is conveyed at a speed of 150 mm/s for print-processing. When a color print mode is selected as the print mode, the CPU 205 sends to the printer unit 203 a command to perform processing for shifting to color printing.

The processing for shifting to color printing shifts all printing units (printing units 2Y, 2M, 2C, and 2Bk) to an operation state. More specifically, the CPU 205 sends to the CPU 2003 of the printer unit 203 a command for applying voltage to the charging rollers 25Y, 25M, 25C, and 25Bk and a command for applying voltage to development rollers (not shown) of the development devices 26Y, 26M, 26C, and 26Bk. In addition, the CPU 205 sends a command for applying voltage to the secondary transfer roller 4, to the CPU 2003 of the printer unit 203.

After receiving the command from the CPU 205, the CPU 2003 starts applying voltage to the charging rollers 25Y, 25M, 25C, and 25Bk via the charging control unit 2005.

Further, the CPU 2003 starts applying voltage to the development roller included in each development device 26Y, 26M, 26C, and 26Bk via the development control unit 2007. Furthermore, the CPU 2003 starts applying voltage to the secondary transfer roller 4 via the transfer control unit 2008.

When the CPU 2003 determines that the printing units 2Y, 2M, 2C, and 2Bk have shifted to an operation state after applying voltage to the development roller and the secondary transfer roller 4, the CPU 2003 notifies the CPU 205 that the printing units 2Y, 2M, 2C, and 2Bk have shifted to the operation state.

When the CPU 205 receives the notification that the printing units 2Y, 2M, 2C, and 2Bk have shifted to the operation state, the CPU 205 sends to the CPU 2003 a command for conveying a sheet at a speed of 150 mm/s to start color print processing using the printing units 2Y, 2M, 2C, and 2Bk. When the CPU 2003 receives the command from the CPU 205, the CPU 2003 controls a rotation speed of various rollers included in the printing apparatus 100 to convey the sheet at the speed of 150 mm/s.

In the processing for shifting to color printing, time taken until the processing is completed, is longer than the processing for shifting to monochromatic printing. This is because in the processing for shifting to monochromatic printing, only the printing unit 2Bk is shifted to its operation state while in the processing for shifting to color printing, all the printing units 2Y, 2M, 2C, and 2Bk are shifted to the operation state.

(3) Auto Color Selection Mode

An auto color selection mode is suitable when it is likely that both monochromatic image data and color image data can be present in one job. In an embodiment, in the auto color selection mode, a sheet is conveyed at a speed of 150 mm/s for print-processing. The auto color selection mode is suitable, for example, in the case of print processing in which a sheet stacked in the original document feed unit 250, is read as image data by the scanner unit 201 and the printer unit 203 performs print processing according to the read image data (so-called copy processing).

When a low speed monochromatic print mode is selected as the print mode, the CPU 205 sends a command to perform processing for shifting to monochromatic printing, to the printer unit 203. The processing for shifting to monochromatic printing shifts the printing unit 2Bk of the plural printing units (printing units 2Y, 2M, 2C, and 2Bk), to an operation state.

More specifically, the CPU 205 sends to the CPU 2003 of the printer unit 203, a command for applying voltage to the charging roller 25Bk, a command for applying voltage to a development roller (not shown) of the development device 26Bk, and a command for applying voltage to the secondary transfer roller 4. In response to the command from the CPU 205, the CPU 2003 starts applying voltage to the charging roller 25Bk via the charging control unit 2005.

Further, the CPU 2003 starts applying voltage to the development roller via the development control unit 2007, and starts applying voltage to the secondary transfer roller 4 via the transfer control unit 2008. When the CPU 2003 determines that the printing unit 2Bk has shifted to an operation state after applying voltage to the development roller and the secondary transfer roller 4, the CPU 2003 notifies the CPU 205 that the printing unit 2Bk has shifted to its operation state.

When the CPU 205 receives the notification that the printing unit 2Bk has shifted to the operation state, the CPU 205 sends to the CPU 2003 a command for conveying a sheet at a speed of 150 mm/s to start monochromatic print processing using the printing unit 2Bk. When the CPU 2003 receives the command from the CPU 205, the CPU 2003 controls a rotation speed of various rollers included in the printing apparatus 100 to convey the sheet at the speed of 150 mm/s.

Now, an operator of the printing apparatus 100 selects one of the three print modes described above which is used for performing print processing. Following describes such a selection by the user.

Figure 4:
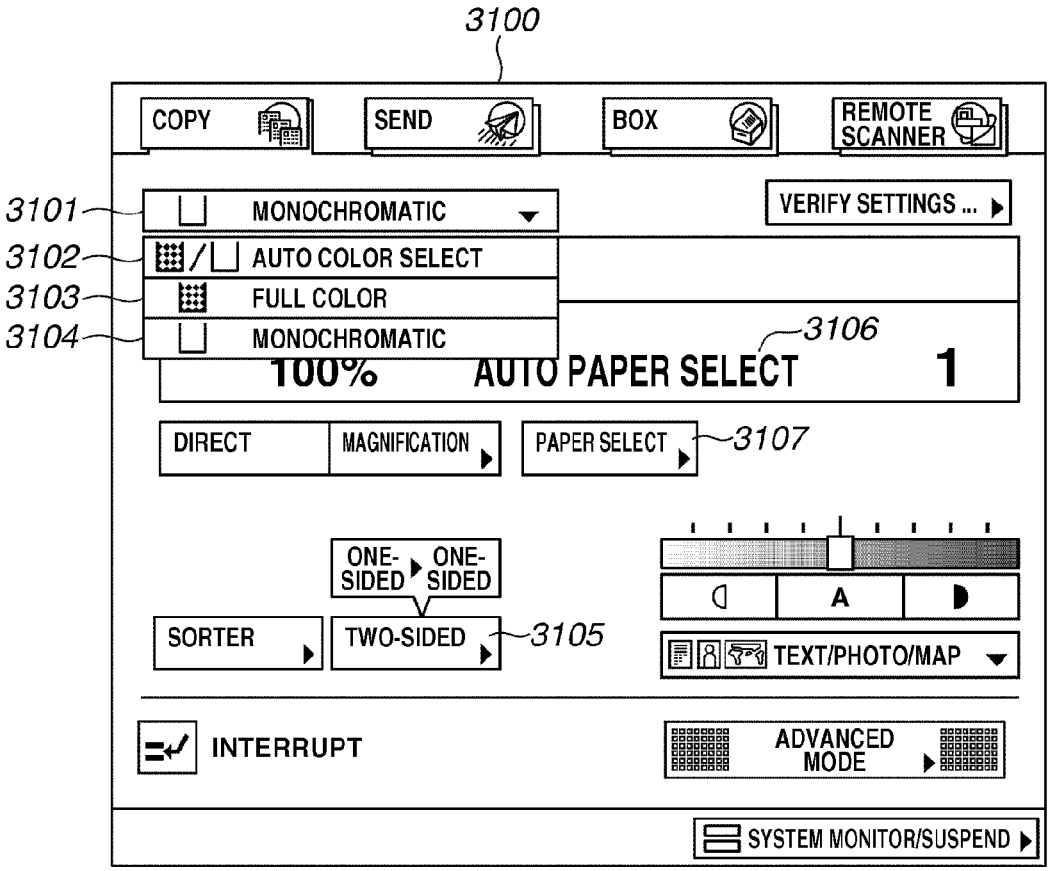
FIG. 4 illustrates a copy setting screen displayed on an operation unit 4 according to the exemplary embodiment of the present invention.

FIG. 4 illustrates an example of a copy setting screen 3100 displayed in the operation unit 204 according to the first exemplary embodiment. The copy setting screen 3100 is displayed in the operation unit 204 under control of the CPU 205.

An operator of the printing apparatus 100 places an original document to be copied, onto the original document feed unit 250 and performs various settings for a copy operation via the copy setting screen 3100. The operator of the printing apparatus 100 presses a start key (not shown) included in the operation unit 204 to copy (print processing) the original document according to the copy operation set via the copy setting screen 3100.

The copy setting screen 3100 illustrated in FIG. 4 indicates a case where the original document is one-sided and the print processing is performed on one side of the print sheet.

Referring to FIG. 4, a field 3101 indicates a currently selected color mode. When the operator presses the field 3101, a pull down menu is displayed. The operator can make a selection among the auto color selection mode, the full color mode, and the monochromatic mode by operating either one of fields 3102, 3013, and 3104.

In the auto color selection mode 3102, a determination as to whether the original document includes color image data is automatically made. The CPU 205 determines page by page whether image data input by the scanner unit 201 is color image data or monochromatic (black and white) image data.

Using a two-sided printing setting button 3105, the operator can make a selection as to whether the input original document is one-sided or two-sided and whether an output result is to be one-sided or two-sided.

A paper selection state display field 3106 indicates a method of selecting a sheet to be used in a print job. As can be seen from FIG. 4, in the copy setting screen 3100, "Auto Paper Select" is displayed which indicates that an output paper is automatically selected (auto paper select) according to a paper size of the input original document.

At the time the input original document size is finally determined, the CPU 205 determines which one of the cassettes 311 through 315 is to be used. The CPU 205 changes the display in the paper selection state display field 3106 to show the finally determined paper size. A paper selection button 3107 is pressed by the operator when the print sheet used in the print job is manually or automatically selected.

When the operator presses the start key (not shown) in the display state of the screen illustrated in FIG. 4, the copy operation starts under the set conditions.

Now, the print processing performed by the printing apparatus 100 is described below with reference to the flow chart in FIG. 5.

The CPU 205 performs each step in the flow chart in FIG. 5 by reading and executing the program stored in the ROM 207 to the RAM 208.

[Operation in Full Color Mode]

When the operator makes various settings for the copy operation via the copy setting screen 3100 in FIG. 4, the operator of the printing apparatus 100 presses the start key (not shown) of the operation unit 204, and the flow illustrated in FIG. 5 starts.

Hereinbelow, an operation that is performed when the full color mode is selected by the operator as the print mode, is described.

In step S501, the CPU 205 determines whether the print mode selected by the operator of the printing apparatus 100 is the full color mode. If it is determined that the print mode selected by the operator of the printing apparatus 100 is the full color mode (Yes in step S501), then the CPU 205 advances to step S502.

In step S502, the CPU 205 performs the processing for shifting to color printing. In the processing for shifting to color printing, all the printing units (the printing units 2Y, 2M, 2C, and 2Bk) are shifted to the operation state.

In step S503, the CPU 205 determines whether the next page to be printed, includes color image data. If it is determined in step S503 that the next page to be printed, includes color image data (Yes in step S503), then the CPU 205 advances to step S504. On the other hand, if it is determined in step S503 that the next page to be printed, includes monochromatic image data (No in step S503), then the CPU 205 advances to step S506.

In step S504, the CPU 205 determines whether the processing for shifting to color printing has already been performed. If it is determined that the processing has already been performed (Yes in step S504), then the CPU 205 advances to step S506.

In step S506, the CPU 205 performs print processing according to image data input by the scanner unit 201. Note that in step S506, the printing apparatus 100 performs the print processing while conveying the print sheet at a speed of 150 mm/s.

In step S507, the CPU 205 determines whether the page print-processed in step S506 is the last page of the print job. If it is determined that the print-processed page is the last page of the print job (Yes in step S507), then the CPU 205 advances to step S514. If it is determined that the print-processed page is not the last page of the print job (No in step S507), then the CPU 205 returns to step S503.

In the full color mode, when monochromatic image data is input, although the determination as to whether a page includes color image data is made in step S503, the print sheet is conveyed at the speed of 150 mm/s in the print processing. This operation prevents consuming of time for print mode shifting processing, in which the print sheet in the printing apparatus 100 is discharged to the outside, during the print processing.

In step S514, the CPU 205 performs print termination processing after the last page of the print job is printed. The print termination processing is processing in which all printing units (the printing units 2Y, 2M, 2C, and 2Bk) are shifted to a suspension state.

More specifically, in the print termination processing, the CPU 205 sends to the CPU 2003 a command for discontinuing supply of voltage to the charging rollers 25Y, 25M, 25C and 25Bk and a command for discontinuing supply of voltage to the development rollers (not shown) of the development devices 26Y, 26M, 26C, and 26Bk.

Furthermore, the CPU 205 sends to the CPU 2003 of the printer unit 203, a command for discontinuing supply of voltage to the secondary transfer roller 4. After receiving the command from the CPU 205, the CPU 2003 suspends the supply of voltage to the charging rollers 25Y, 25M, 25C and 25Bk via the charging control unit 2005.

Further, the CPU 2003 suspends the supply of voltage to the development roller included in the development devices 26Y, 26M, 26C, and 26Bk via the development control unit 2007. Furthermore, the CPU 2003 suspends the supply of voltage to the secondary transfer roller 4 via the transfer control unit 2008.

When the CPU 2003 determines that the printing units 2Y, 2M, 2C, and 2Bk are shifted to the suspension state due to the suspension of voltage supply to the charging rollers 25Y, 25M, 25C and 25Bk, the development roller, and the secondary transfer roller 4, the CPU 2003 sends a notification to the CPU 205 indicating that the printing units 2Y, 2M, 2C, and 2Bk are shifted to the suspension state.

Now, a relationship between a sheet conveyance speed and the time taken for the print processing when the print processing for image data of five pages, for example, is performed in the full color mode, is described below with reference to FIG. 7A. Here, FIG. 7B illustrates an example compared to the full color mode according to the present exemplary embodiment.

Figure 7A:
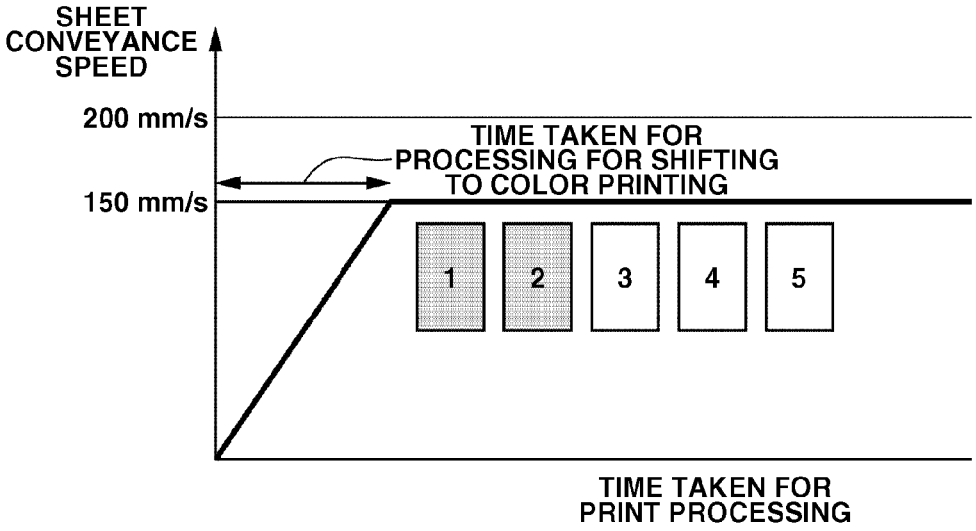
FIG. 7A illustrates a relationship between a sheet conveyance speed and time taken for the print processing in a full color mode according to the exemplary embodiment of the present invention.
Figure 7B:
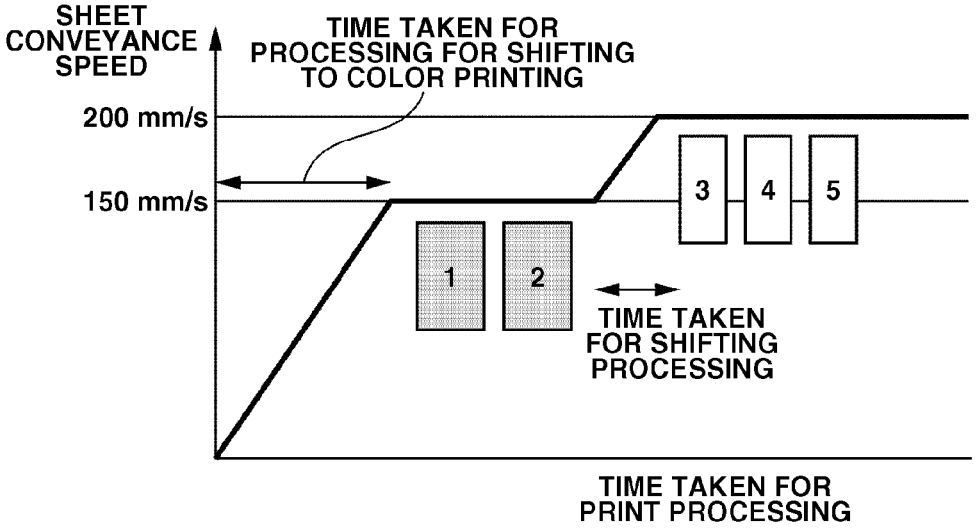
FIG. 7B illustrates an example to be compared with the full color mode according to the exemplary embodiment of the present invention.

In the examples illustrated in FIG. 7A and FIG. 7B, first and second pages of the five page print job are color image data, and third to fifth pages are monochromatic image data.

In FIG. 7B, print mode shifting processing is performed at the timing between processing for a second page and processing for a third page. On the other hand, in FIG. 7A, print mode shifting processing is not performed at the timing between processing for a second page and processing for a third page, in which the print processing shifts from the page including color image data to the page including monochromatic image data. Accordingly, the sheet conveyance speed is not changed.

As is clear when the examples illustrated in FIG. 7A and FIG. 7B are compared, in the example illustrated in FIG. 7B, the time for the print mode shifting processing is required. Accordingly, the time taken until the print processing ends, is longer in the example illustrated in FIG. 7B than in FIG. 7A.

[Operation in Monochromatic Mode]

When the operator makes various settings for the copy operation via the copy setting screen 3100 in FIG. 4, the operator of the printing apparatus 100 presses the start key (not shown) of the operation unit 204, and the flow illustrated in FIG. 5 starts.

Hereinbelow, an operation that is performed when the monochromatic mode is selected by the operator as the print mode, is described.

In step S501, the CPU 205 determines whether the print mode selected by the operator of the printing apparatus 100 is the full color mode. If it is determined that the print mode selected by the operator of the printing apparatus 100 is the monochromatic mode (No in step S501), then the CPU 205 advances to step S508.

In step S508, the CPU 205 performs the processing for shifting to monochromatic printing. In the processing for shifting to monochromatic printing, the printing unit 2Bk is shifted to the operation state, as described above.

In step S509, the CPU 205 determines whether the set print mode is the auto color selection mode. If it is determined that the set print mode is the monochromatic mode (No in step S509), then the CPU 205 advances to step S510.

In step S510, the CPU 205 determines whether the next page in the print job includes color image data. If it is determined that the next page includes color image data (Yes in step S510), then the CPU 205 advances to step S513. On the other hand, if it is determined that the next page does not include color image data (No in step S510), then the CPU 205 advances to step S511.

In step S511, the CPU 205 performs print processing according to image data input by the scanner unit 201. In step S511, the printing apparatus 100 performs the print processing while conveying the print sheet at a speed of 200 mm/s.

In step S512, the CPU 205 determines whether the page print-processed in step S511 is the last page of the print job. If it is determined that the print-processed page is the last page of the print job (Yes in step S512), then the CPU 205 advances to step S514. On the other hand, if it is determined that the print-processed page is not the last page of the print job (No in step S512), then the CPU 205 returns to step S510. The operation performed in step S514 is as described above.

In step S513, the CPU 205 performs print mode shifting processing. More specifically, the CPU 205 performs steps illustrated in FIG. 6.

Figure 6:
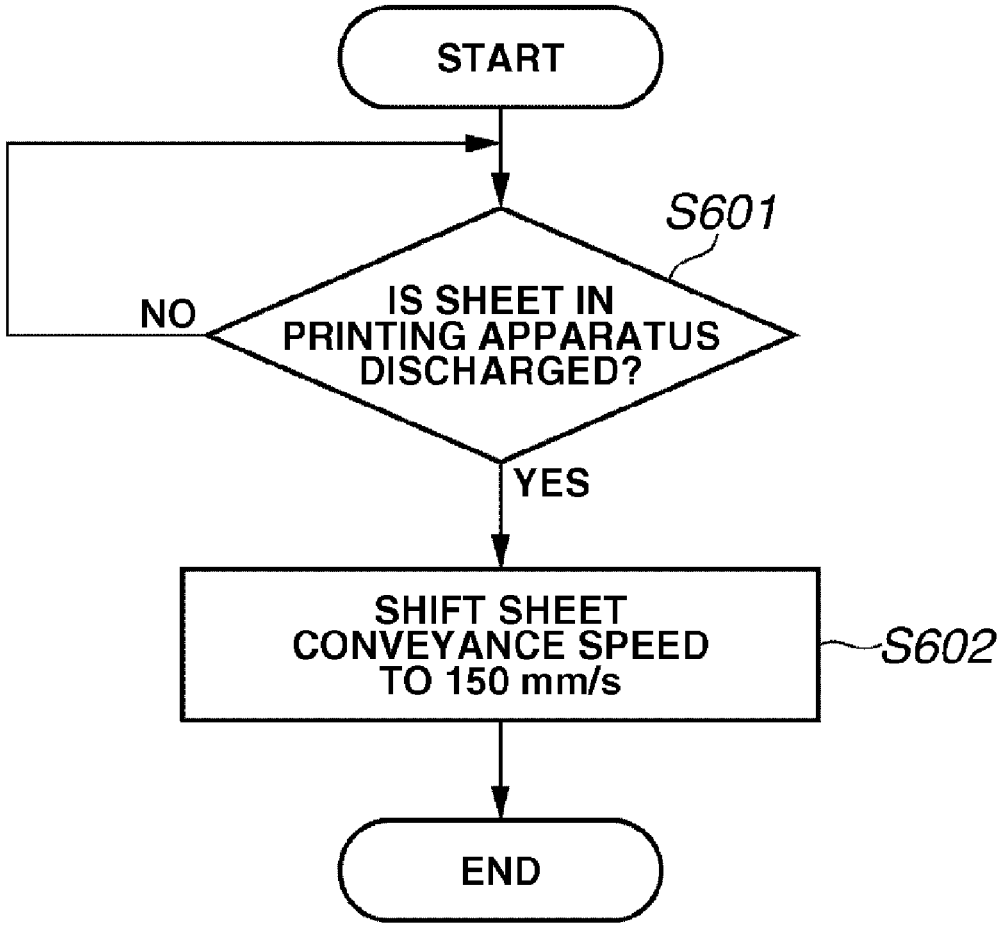
FIG. 6 is a flow chart illustrating print mode shifting processing according to the exemplary embodiment of the present invention.

Referring to FIG. 6, in step S601, the CPU 205 determines whether the print sheet in the printing apparatus 100 has already been discharged. If it is determined that the print sheet in the printing apparatus 100 has already been discharged (Yes in step S601), then the CPU 205 advances to step S602. On the other hand, if it is determined that the print sheet has not been discharged yet (No in step S601), then the CPU 205 repeats the processing in step S601. The CPU 205 determines whether the print sheet in the printing apparatus 100 has already been discharged because the print processing can fail if the sheet conveyance speed is changed during the print processing.

In step S602, the CPU 205 sends a command to the CPU 2003 to change the sheet conveyance speed from 200 mm/s to 150 mm/s. When the command is received from the CPU 205, the CPU 2003 causes the sheet conveyance control unit 2004 to change the sheet conveyance speed.

Now, steps performed after the processing in step S513 is completed are described below.

In step S503, the CPU 205 determines whether the next page to be printed includes color image data. If it is determined that the next page to be printed includes color image data (Yes in step S503), then the CPU 205 advances to step S504.

In step S504, the CPU 205 determines whether the processing for shifting to color printing has already been performed. If it is determined that the processing for shifting to color printing has not been performed yet (No in step S504), then the CPU 205 advances to step S505.

In step S505, the CPU 205 performs the processing for shifting to color printing. In the processing for shifting to color printing, all printing units (the printing units 2Y, 2M, 2C, and 2Bk) are shifted to the operation state, as described above.

Note that in the processing for shifting to color printing in step S505, in contrast to the processing for shifting to color printing in step S502, the printing units except for the printing unit 2Bk (namely, the printing units 2Y, 2M, and 2C) are shifted to the operation state. This is because the printing unit 2Bk has already been shifted to the operation state in step S508.

However, in order to further stabilize the operation state of the printing units 2, the processing for shifting all printing units (the printing units 2Y, 2M, 2C, and 2Bk) can be performed in step S505.

In step S506, the CPU 205 performs print processing according to image data input by the scanner unit 201. In step S506, the printing apparatus 100 performs the print processing while conveying the print sheet at a speed of 150 mm/s.

In step S507, the CPU 205 determines whether the page print-processed in step S506 is the last page of the print job. If it is determined that the print-processed page is the last page of the print job (Yes in step S507), then the CPU 205 advances to step S514. On the other hand, if it is determined that the print-processed page is not the last page of the print job (No in step S507), then the CPU 205 returns to step S503. The processing in step S514 is as described above.

Thus, in the monochromatic mode, if the print job does not include color image data, each page is print-processed in step S511. On the other hand, if the print job includes color image data, after performing the print mode shifting processing, the subsequent page is print-processed in step S506.

Once the print mode shifting processing is performed, even when a page including monochromatic image data is present after the completion of the print mode shifting processing, the print processing is performed in step S506. In the monochromatic mode, the image data input by the scanner unit 201 can be compulsorily converted into monochromatic image data. In this case, all the pages in the print job include monochromatic image data. Accordingly, the print processing can be performed at a high speed without lowering a throughput (the number of pages printable per each unit time) by performing the processing in step S513.

[Operation in Auto Color Selection Mode]

when the operator makes various settings for the copy operation via the copy setting screen 3100 in FIG. 4, the operator of the printing apparatus 100 presses the start key (not shown) of the operation unit 204, and the flow illustrated in FIG. 5 starts.

Hereinbelow, an operation performed when the auto color selection mode is selected by the operator as the print mode, is described.

In step S501, the CPU 205 determines whether the print mode selected by the operator of the printing apparatus 100 is the full color mode. If it is determined that the print mode selected by the operator of the printing apparatus 100 is the auto color selection mode (No in step S501), then the CPU 205 advances to step S508.

In step S508, the CPU 205 performs the processing for shifting to monochromatic printing. In the processing for shifting to monochromatic printing, the printing unit 2Bk is shifted to the operation state, as described above.

In step S509, the CPU 205 determines whether the set print mode is the auto color selection mode. If it is determined that the set print mode is the auto color selection mode (Yes in step S509), then the CPU 205 advances to step S503.

In step S503, the CPU 205 determines whether the next page to be printed includes color image data. If it is determined that the next page to be printed includes color image data (Yes in step S503), then the CPU 205 advances to step S504. On the other hand, if it is determined that the next page to be printed includes monochromatic image data (No in step S503), then the CPU 205 advances to step S506.

In step S504, the CPU 205 determines whether the processing for shifting to color printing has already been performed. If it is determined that the processing for shifting to color printing has not been performed yet (No in step S504), then the CPU 205 advances to step S505.

In step S505, the CPU 205 performs the processing for shifting to color printing. In the processing for shifting to color printing, all printing units (the printing units 2Y, 2M, 2C, and 2Bk) are shifted to the operation state, as described above.

In the processing for shifting to color printing in step S505, in contrast to the processing for shifting to color printing in step S502, the printing units except for the printing unit 2Bk (namely, the printing units 2Y, 2M, and 2C) are shifted to the operation state. This is because the printing unit 2Bk has already been shifted to the operation state in step S508.

However, in order to further stabilize the operation state of the printing units 2, the processing for shifting all printing units (the printing units 2Y, 2M, 2C, and 2Bk) can be performed in step S505.

In step S506, the CPU 205 performs print processing according to image data input by the scanner unit 201. In step S506, the printing apparatus 100 performs the print processing while conveying the print sheet at a speed of 150 mm/s.

In step S507, the CPU 205 determines whether the page print-processed in step S506 is the last page of the print job. If it is determined that the print-processed page is the last page of the print job (Yes in step S507), then the CPU 205 advances to step S514. On the other hand, if it is determined that the print-processed page is not the last page of the print job (No in step S507), then the CPU 205 returns to step S503. The processing in step S514 is as described above.

Thus, in the auto color selection mode, if the print job does not include color image data, the print processing ends without performing the processing for shirting to color printing in step S505. Accordingly, if a print job does not include color image data, the time taken for the print processing can be reduced as the time for performing the processing for shifting to color printing can be omitted.

Now, reduction of the time taken for the print processing is described with reference to FIG. 8A.

Figure 8A:
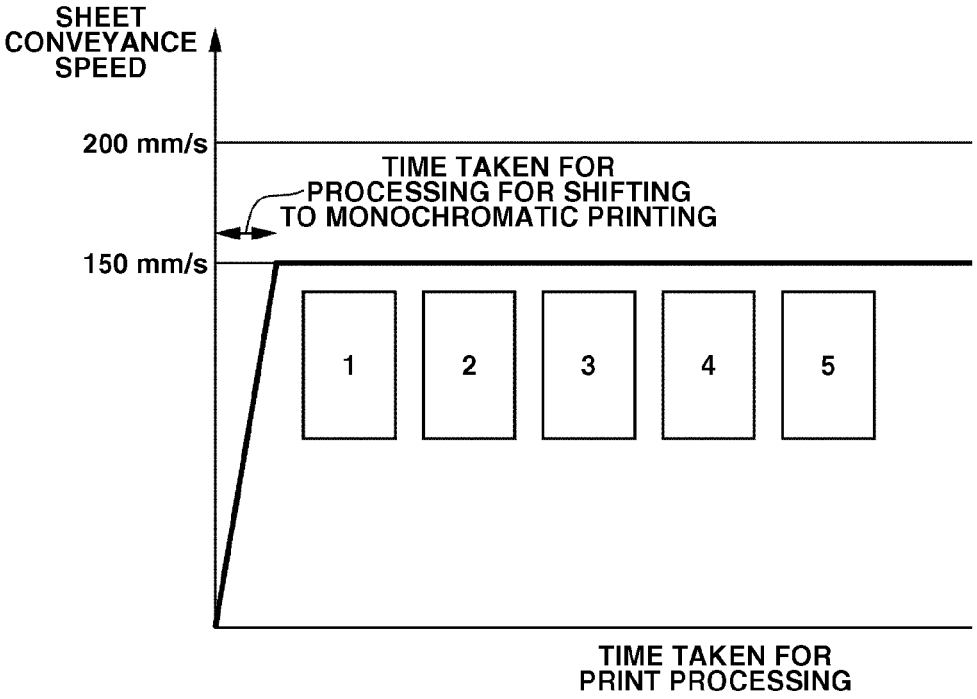
FIG. 8A illustrates a relationship between a sheet conveyance speed and time taken for the print processing in an auto color selection mode according to the exemplary embodiment of the present invention.
Figure 8B:
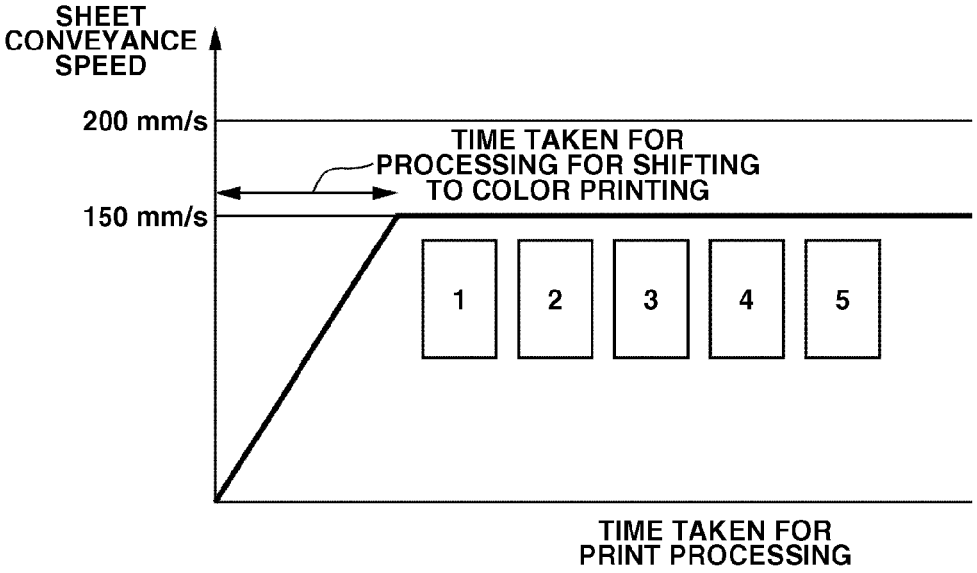
FIG. 8B illustrates an example to be compared to the full color mode according to the exemplary embodiment of the present invention.

Here, FIG. 8B illustrates an example compared to the full color mode according to the present exemplary embodiment. The print job illustrated in FIG. 8A and FIG. 8B includes five pages of monochromatic image data.

In the example illustrated in FIG. 8A, while the processing for shifting to monochromatic printing (the processing in step S508) is performed, the print processing ends without performing the processing for shifting to color printing (the processing in step S505), because the print job does not include color image data.

On the other hand, if the processing for shifting to color printing (the processing in step S502) is performed before starting the processing of the print job, as illustrated in the example in FIG. 8B, it takes longer time until the print processing ends because the time is consumed in the processing for shifting to color printing and the processing for shifting to monochromatic printing. That is, if the operation (the operation illustrated in FIG. 8A) is performed according to the present exemplary embodiment, the time taken for the print processing can be reduced.

Further, in the auto color selection mode according to the present exemplary embodiment, even when color image data is input after input of monochromatic image data, the sheet conveyance speed is not changed although the processing for shifting to color printing is performed. Accordingly, the shifting processing as shown in step S513 does not need to be performed. Furthermore, in performing a print job including color image data, the time taken for the print processing does not become longer compared with the print processing performed in the full color mode.

Figure 9A:
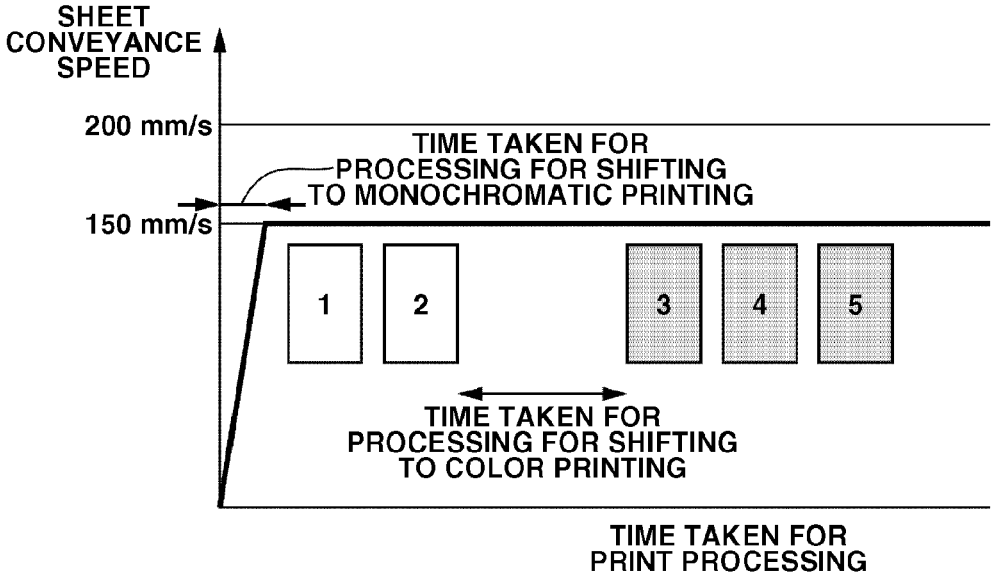
FIG. 9A illustrates a relationship between a sheet conveyance speed and time taken for the print processing in the auto color selection mode according to the exemplary embodiment of the present invention.
Figure 9B:
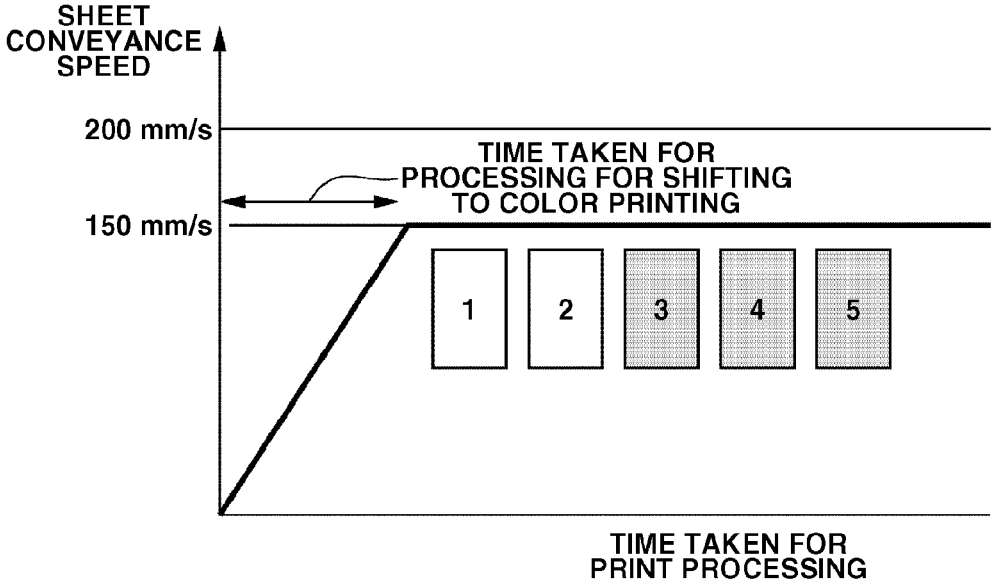
FIG. 9B illustrates a relationship between a sheet conveyance speed and time taken for the print processing in the full color selection mode according to the exemplary embodiment of the present invention.

Now, an effect of the present exemplary embodiment is described, namely, the time taken for the print processing does not become longer compared with the print processing performed in the full color mode, with reference to FIG. 9A and FIG. 9B.

FIG. 9A illustrates an operation performed in the case where a print job including five pages (first and second pages include monochromatic image data and third to fifth pages include color image data) is print-processed in the auto color selection mode. FIG. 9B illustrates an operation in the case where the same print job as in FIG. 9A is performed in the full color mode.

In the example illustrated in FIG. 9B, the processing for shifting to color printing is performed before starting the print processing. On the other hand, in the example illustrated in FIG. 9A, the processing for shifting to color printing is performed just before the print processing of color image data (e.g., the third page).

In the processing for shifting to color printing illustrated in FIG. 9A, the printing units except for the printing unit 2Bk are shifted to the operation state because the processing for shifting to monochromatic printing is performed before starting the print processing. Accordingly, the time taken for the processing for shifting to color printing in the example illustrated in FIG. 9B is substantially the same as the time length obtained by adding the time taken for the processing for shifting to monochromatic printing as illustrated in FIG. 9A, to the time taken for the processing for shifting to color printing. That is, it takes almost the same time to process the printing job of five pages both in FIG. 9A and FIG. 9B.

As described above, the first exemplary embodiment provides the printing apparatus and the printing method which includes the processing for shifting to monochromatic printing to transfer the printing apparatus to the state in which monochromatic printing can be performed, and the processing for shifting to color printing to transfer the printing apparatus to the state in which color printing can be performed. The processing for shifting to monochromatic printing and the processing for shifting to color printing are appropriately performed before starting the print processing, according to the selected one mode among the plural print modes.

Second Exemplary Embodiment

Now, a second exemplary embodiment of the present invention is described below.

The second exemplary embodiment is different from the first exemplary embodiment in that in the copy setting screen 3100, the setting is performed by the operator of the printing apparatus 100 so that the original document is one-sided and the print processing is to be performed on two sides of a print sheet.

In the description below, only the points different from the first exemplary embodiment are described and the other points similar to the first exemplary embodiment are not repeated here.

A copy operation by the printing apparatus 100 according to the second exemplary embodiment is similar to that described in the flow chart in FIG. 5, except for the processing in step S513.

The processing in step S513 is different from the first exemplary embodiment with respect to the specific operation performed in the print mode shifting processing, and is described below with reference to FIG. 10.

Figure 10:
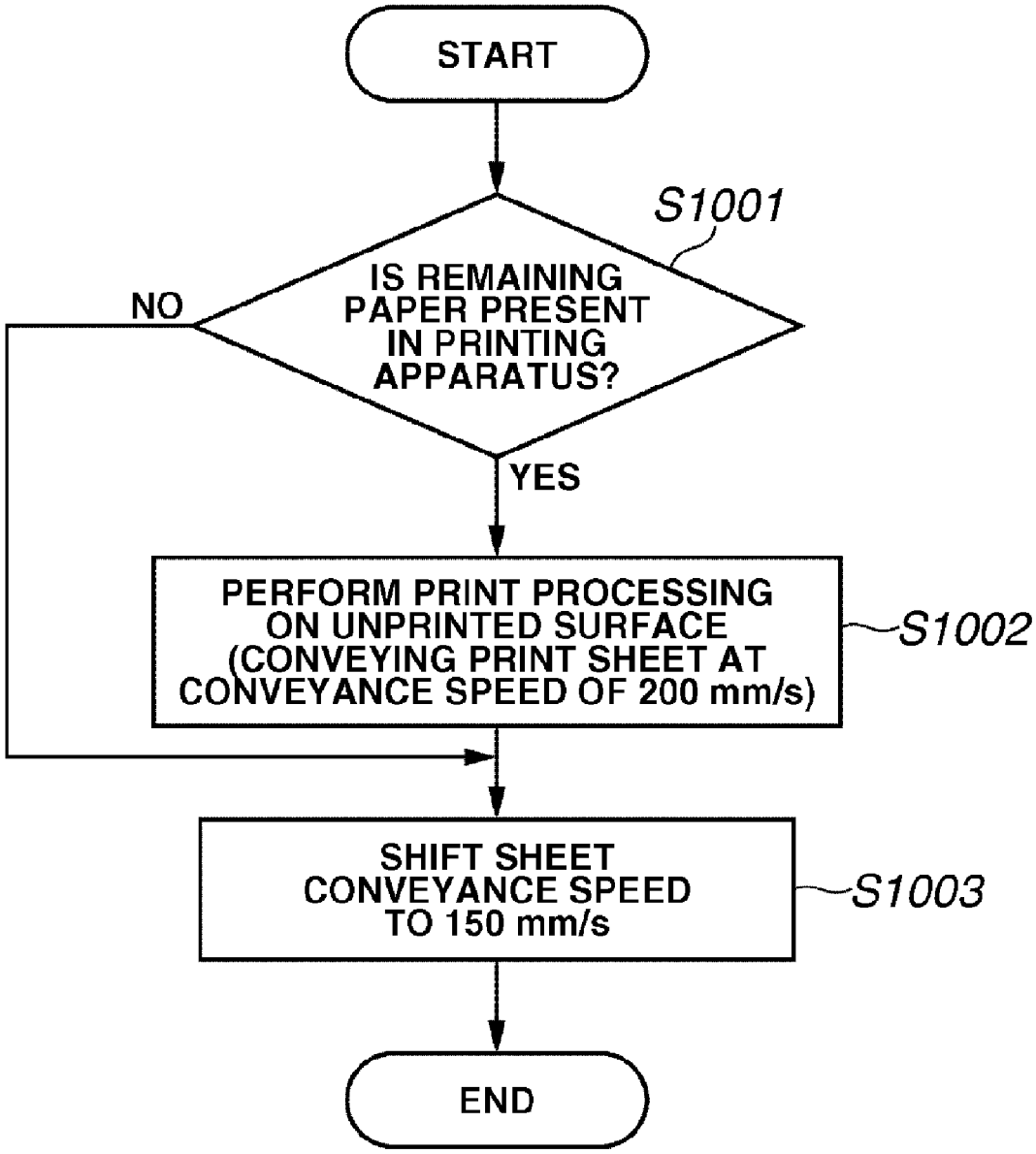
FIG. 10 is a flow chart illustrating a flow of print mode shifting processing according to the exemplary embodiment of the present invention.

In step S1001 in FIG. 10, the CPU 205 determines whether a remaining paper (sheet) exists in an inside of the printing apparatus 100. If it is determined that a remaining paper exists in an inside of the printing apparatus 100 (Yes in step S1001), then the CPU 205 advances to step S1002. On the other hand, if it is determined that no remaining paper exists (No in step S1001), then the CPU 205 advances to step S1003.

In step S1002, the CPU 205 performs the print processing on an unprinted side of the remaining sheet existing in the inside of the printing apparatus 100 while the other side has already been print-processed. In the print processing, the print sheet is conveyed at the speed of 200 mm/s.

In step S1003, the CPU 205 sends a command to the CPU 2003 so that the sheet conveyance speed is changed from 200 mm/s to 150 mm/s. When the CPU 2003 receives the command from the CPU 205, the CPU 2003 causes the sheet conveyance control unit 2004 to change the sheet conveyance speed.

Now, a relationship between a sheet conveyance speed and the time taken for the print processing is described below with reference to FIG. 11A, FIG. 11B, and FIG. 11C. A print job includes image data of ten pages (whose first through sixth pages include monochromatic image data and seventh through tenth pages include color image data).

Figure 11A:
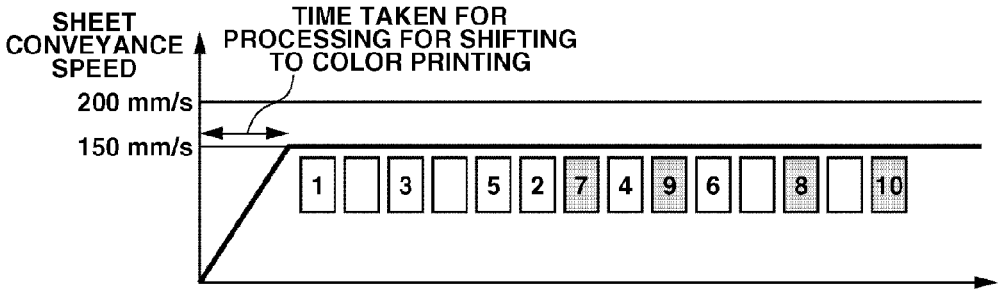
FIG. 11A illustrates a relationship between a sheet conveyance speed and time taken for the print processing in the full color mode according to the exemplary embodiment of the present invention.

FIG. 11A illustrates an example of the print processing in the case where the operator of the printing apparatus 100 selects the full color mode as the print mode.

When the scanner unit 201 generates the image data of ten pages, the CPU 205 inputs the image data by reading ten original documents into the printer unit 203 as one print job. In FIG. 11A, the full color mode is selected as the print mode as described above, and accordingly, the processing for shifting to color printing is performed before starting the print processing.

Subsequently, the CPU 205 feeds three sheets S from the cassette 311 and performs print processing of image data of the first, the third, and the fifth page, on each of the three sheets S. Then, the CPU 205 forwards the sheets S on which the first, the third, and the fifth pages are print-processed, to a re-feed conveyance path 332.

The sheets S conveyed from the re-feed conveyance path 332 are then conveyed to the secondary transfer roller 4 with a print-processed side face down. The printing apparatus 100 can perform the print processing of the image data of the first, the third, and the fifth pages because three sheets can be retained at the same time in the printing apparatus 100.

Then, the CPU 205 forwards the sheet S on which the image data for the first page is print-processed, to the secondary transfer roller 4 and performs the print processing of the image data of a second page. Subsequently, the CPU 205 discharges the sheet S on which both image data of the first and the second pages are print-processed, via the conveyance path 334, out of the printing apparatus 100.

Then, the CPU 205 performs the print processing of the image data of a seventh page on the sheet S fed from the cassette 311. Then, the CPU 205 forwards the sheet S on which the third page is print-processed, to the secondary transfer roller 4 and performs the print processing of the image data of a fourth page.

Then, the CPU 205 performs the print processing of the image data of a ninth page on the sheet S fed from the cassette 311. Then, the CPU 205 serially forwards the sheets S onto which the fifth, the seventh, and the ninth pages are print-processed, from the re-feed conveyance path 332 to the transfer unit 325. Then, the CPU 205 performs the print processing of the image data of sixth, eighth, and tenth pages on the sheets S thus forwarded to the transfer unit 325.

A portion surrounded with dotted lines in FIG. 11A indicate an interval between the sheets.

Figure 11B:
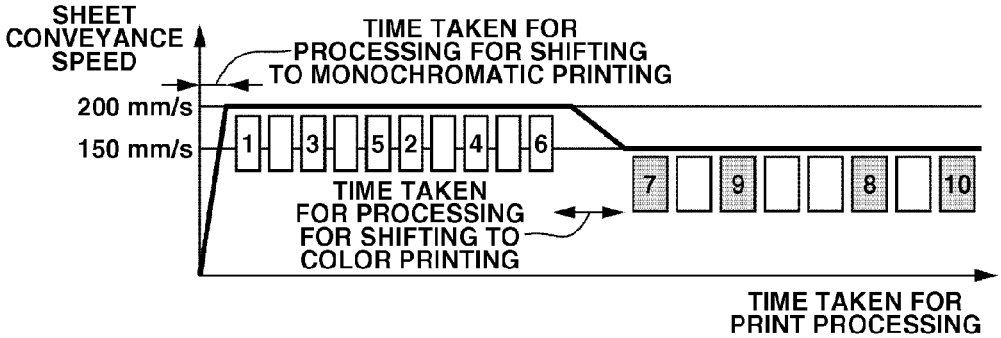
FIG. 11B illustrates a relationship between a sheet conveyance speed and time taken for the print processing in a monochromatic mode according to the exemplary embodiment of the present invention.

FIG. 11B illustrates an example of the print processing that is performed when the operator of the printing apparatus 100 selects the monochromatic mode as the print mode.

In the example illustrated in FIG. 11A, the seventh page is print-processed after the second page is print-processed. In the monochromatic mode, the first, the third, the fifth, and the second pages are print-processed at the conveyance speed of 200 mm/s. Accordingly, the sheet conveyance speed needs to be lowered to print-process the color image data of the seventh page. Further, in the monochromatic mode, only the processing for shifting to monochromatic printing is performed before starting the processing of the print job, and accordingly, the processing for shifting to color printing also needs to be performed at this time.

Referring to FIG. 11B, the CPU 205 print-processes the monochromatic image data of the second, the fourth, and the sixth page, on an unprinted side of the printed sheet before print-processing the color image data of the seventh page, and then discharges the sheet out of the printing apparatus 100 (step S1002).

Then, the CPU 205 changes the sheet conveyance speed from 200 mm/s to 150 mm/s and performs the processing for shifting to color printing. The CPU 205 print-processes the color image data of the seventh and the ninth pages and conveys the sheet on which the seventh and the ninth pages are print-processed, out of the re-feed conveyance path 332.

Then, the CPU 205 print processes the color image data of the eighth page only on the printing side of the sheet on which the image data of the seventh page is print-processed. Furthermore, the CPU 205 print processes the color image data of the tenth page only on the printing side of the sheet on which the image data of the ninth page is print-processed.

When the examples illustrated in FIG. 11A and FIG. 11B are compared, the time taken for the print processing of the first through the sixth pages is shorter in the monochromatic mode than in the other modes. However, the time taken for printing all the ten pages is longer in the monochromatic mode than in the other modes due to the processing for shifting to color printing and changing of the sheet conveyance speed.

Figure 11C:
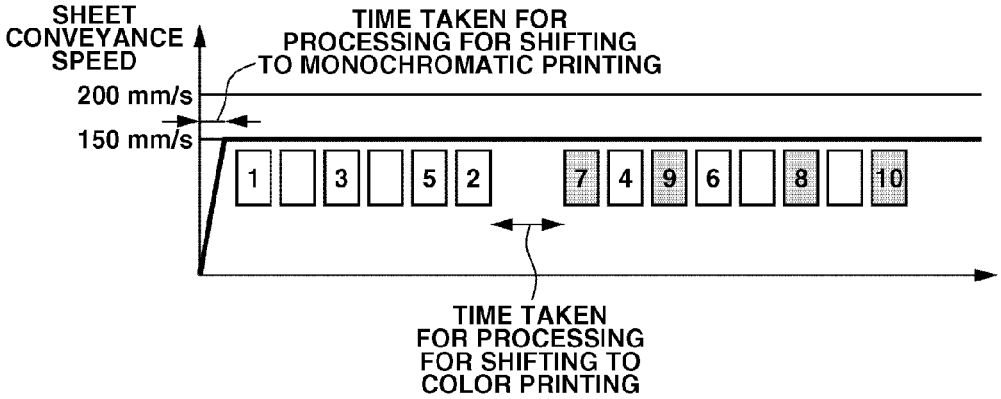
FIG. 11C illustrates a relationship between a sheet conveyance speed and time taken for the print processing in the auto color selection mode according to the exemplary embodiment of the present invention.

FIG. 11C illustrates the print processing performed when the operator of the printing apparatus 100 selects the auto color selection mode as the print mode.

In the example illustrated in FIG. 11C, the order of printing of the pages and the sheet conveyance speed are the same as those in the example illustrated in FIG. 11A. The different point is that in the example of FIG. 11A, the processing for shifting to color printing is performed before starting the print processing, but in the example of FIG. 11C, the processing for shifting to color printing is performed just before starting the print processing of color image data.

As described above, the second exemplary embodiment provides the printing apparatus and the printing method in which the processing for shifting to monochromatic printing to transfer the printing apparatus to the state where monochromatic printing can be performed, and the processing for shifting to color printing to transfer the printing apparatus to the state where color printing can be performed. The processing for shifting to monochromatic printing and the processing for shifting to color printing are appropriately performed before starting the print processing, according to the selected one mode among the plural print modes.

Furthermore, according to the second exemplary embodiment, when two-sided print processing is performed, the processing for shifting to monochromatic printing and the processing for shifting to color printing can be appropriately performed.

Third Exemplary Embodiment

Now, a third exemplary embodiment of the present invention is described below.

In the first and the second exemplary embodiments, the print job includes a plurality of image data. Image data is input by reading an original document with the scanner unit 201. In the third exemplary embodiment, a print job is received from an external apparatus connected to the printing apparatus 100 via the external I/F 202.

Figure 12:
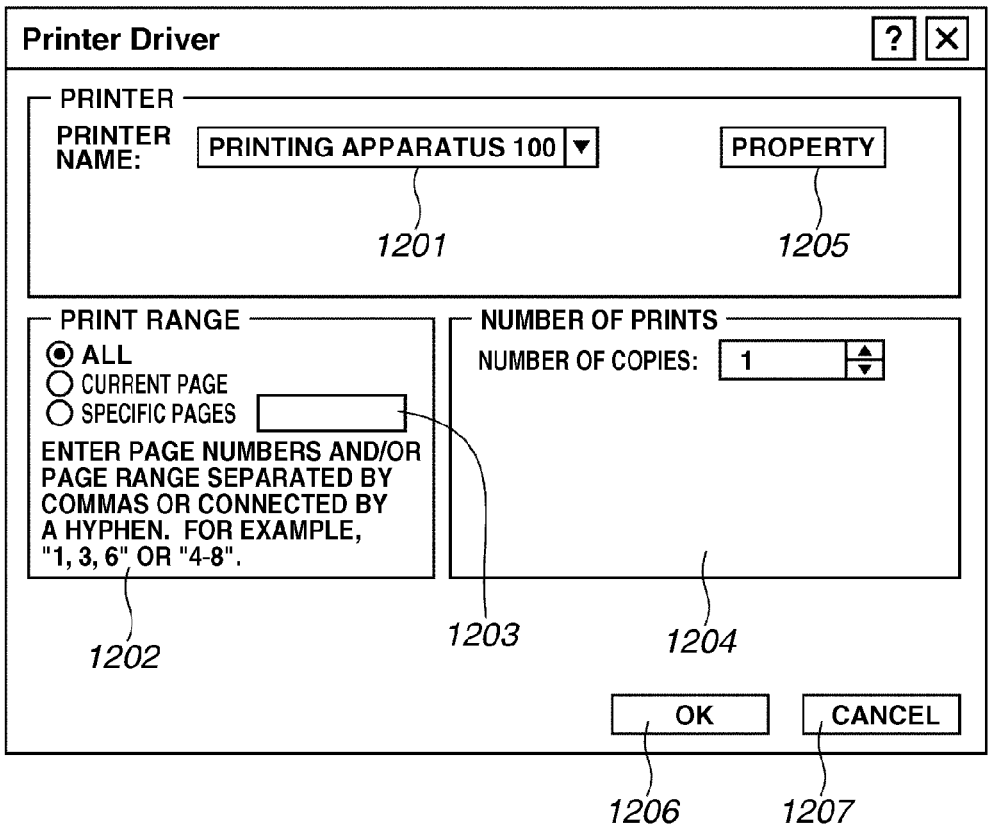
FIG. 12 illustrates an example of a setting screen of a printer driver operating on an external apparatus according to the exemplary embodiment of the present invention.

FIG. 12 illustrates a setting screen for a printer driver operating on an external apparatus (i.e., a computer terminal). The external apparatus displays the setting screen illustrated in FIG. 12 on a display screen by activating the printer driver when a document is created using application software such as a document creation application.

Here, a printer driver is a device driver for controlling the printing apparatus 100 and is software operating on the external apparatus. The external apparatus allows the printer driver to generate a print job to be sent to the printing apparatus 100.

In the setting screen illustrated in FIG. 12, the operator (user) of the external apparatus operates a printer name selection box 1201 with a pointing device (not shown). With this operation, the operator selects the printing apparatus 100 as a sending destination to which the external apparatus sends the print job.

The example illustrated in FIG. 12 shows that the external apparatus selects the printing apparatus 100 as the sending destination. The operator of the external apparatus operates a print range selection box 1202 with the pointing device (not shown).

Thus, a portion in the document that the application creates, is determined as a range to be printed by the printing apparatus 100.

When the operator selects "all" for the print range, the printer driver determines that all the pages of the document created by the application are to be printed. Furthermore, when the operator selects "current page", the printer driver determines that among plural pages created by the application, the page currently displayed on the screen of the external apparatus is to be printed.

Further, when the operator selects "specific pages", the printer driver determines that among plural pages created by the application, the pages input into an edit box 1203 are to be printed. Furthermore, the printer driver recognizes a number of copies entered by the operator in a print number setting box 1204 as a number of copies to be printed.

The operator of the external apparatus starts generating a print job by pressing an OK button 1206 when settings for the print job which are sent to the printing apparatus 100 via the printer driver, are finished. In order to discontinue generation of a print job, the operator of the external apparatus presses a cancel button 1207.

Figure 13:
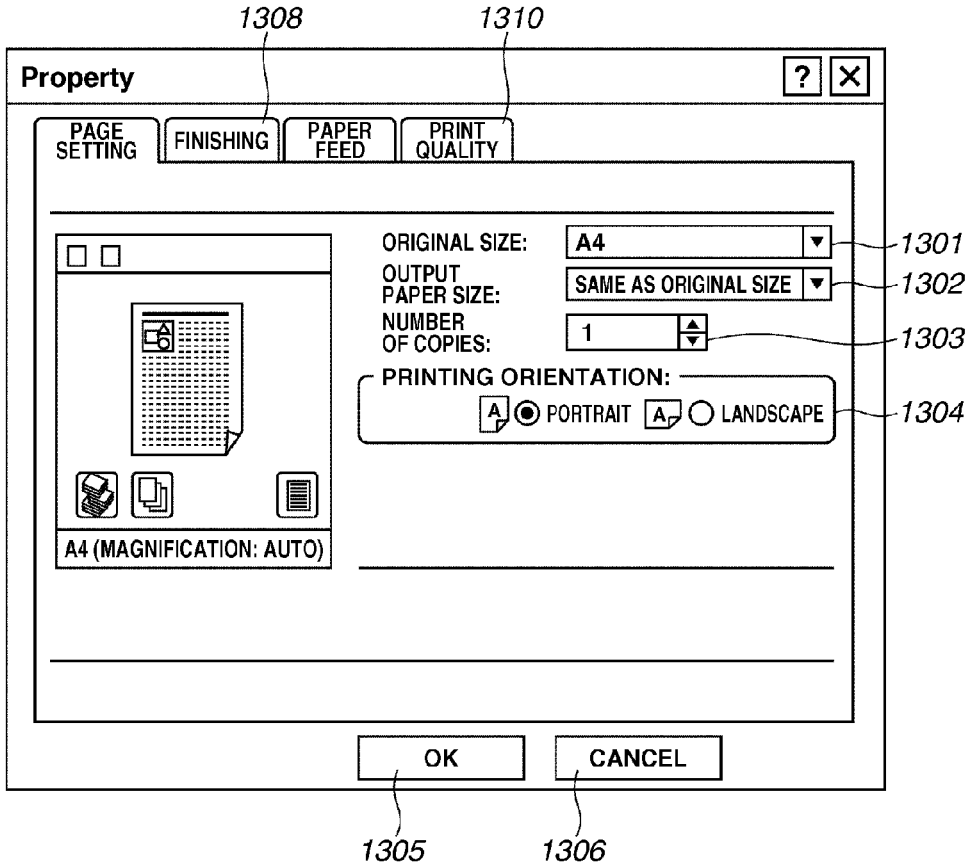
FIG. 13 illustrates an example of a screen displayed when an operator of the external apparatus presses a property button via the printer driver setting screen according to the exemplary embodiment of the present invention.

FIG. 13 illustrates an example of a screen displayed when the operator of the external apparatus presses a property button 1205 via a printer driver property setting screen illustrated in FIG. 12.

The operator of the external apparatus operates original document size selection box 1301 using the pointing device (not shown). With this operation, the printer driver selects a size of each page in application data currently activated on the external apparatus.

In an ordinary case, a document size is designated to the document created according to the application data. Thus, the designated document size is automatically selected. When the operator selects "same as original document size" via an output paper size selection box 1302, the printer driver selects "A4" as the size of the print sheet to be used for the print processing (output processing) by the printing apparatus 100.

The operator can select a desired sheet size such as "A3" and "B5" other than "same as original document size" as the size of the output paper.

In this case, the size different from the original document size is selected. Accordingly, the printer driver generates a print job by changing a magnification rate.

Furthermore, the printer driver sets to the print job the number of copies in response to the input of the desired number of prints entered by the operator via a print number selection box 1303. Moreover, the printer driver inputs the print orientation selected by the operator via a print orientation designation box 1304.

The printer driver finally determines values entered in the original document size selection box 1301, the output paper size selection box 1302, the print number selection box 1303, and the print orientation designation box 1304, when the operator presses an OK button 1305. On the other hand, if the operator presses a cancel button 1306, the printer driver restores the values to default setting values previously determined.

Figure 14:
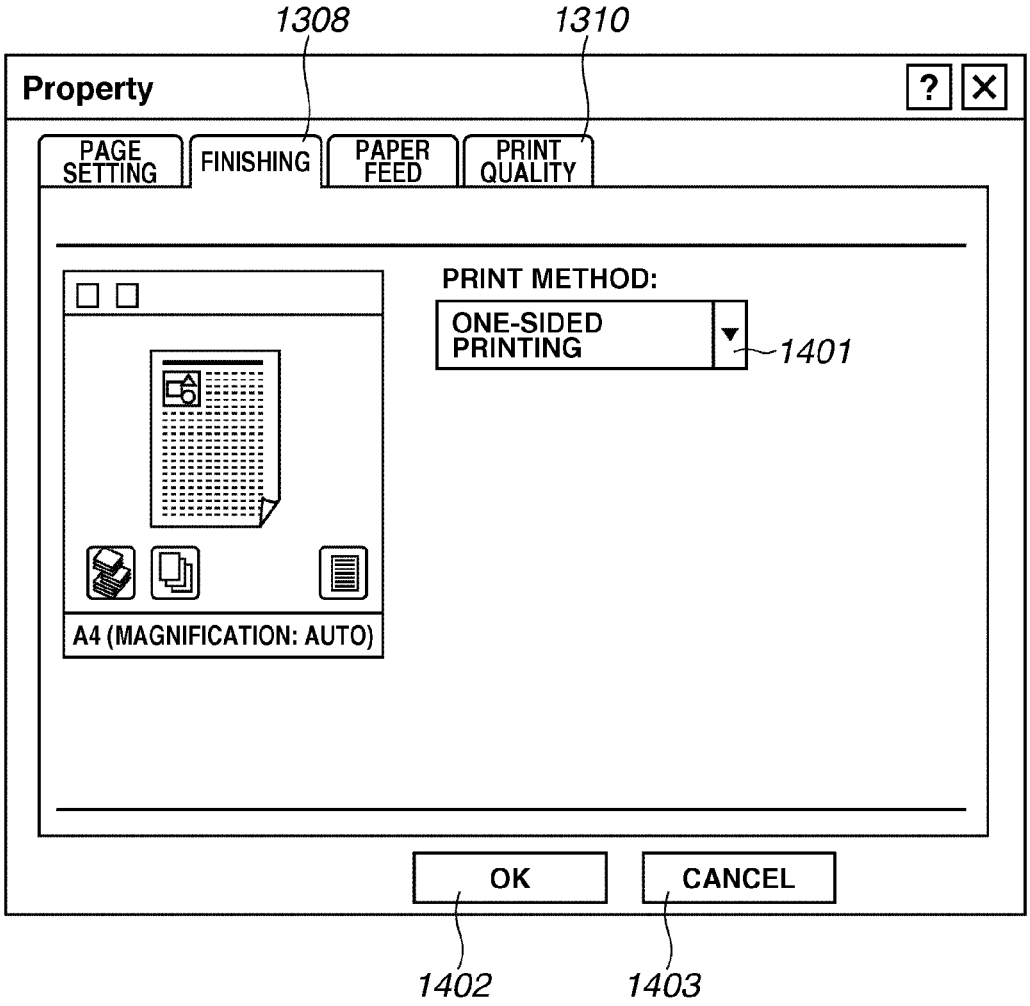
FIG. 14 illustrates an example of a screen displayed when an operator of the external apparatus presses a finishing tab via the printer driver setting screen according to the exemplary embodiment of the present invention.

FIG. 14 illustrates a screen displayed when a finishing tab 1308 is selected by the operator via the printer driver property setting screen illustrated in FIG. 13.

The operator of the external apparatus operates a print method selection box 1401 using the pointing device (not shown). With this operation, the printer driver selects the print method used for the print processing of the print job created according to the application data, in the printing apparatus 100.

As for the print method, "one-sided printing", which print-processes only one side of the sheet, and "two-sided printing", which print-processes both sides of the sheet, are provided.

When the operator presses an OK button 1402, the printer driver finally determines the value that is entered in the print method selection box 1401. On the other hand, if the operator presses a cancel button 1403, the printer driver does not finally determines the value that is entered in the print method selection box 1401 and restores the value to the default setting value previously determined.

Figure 15:
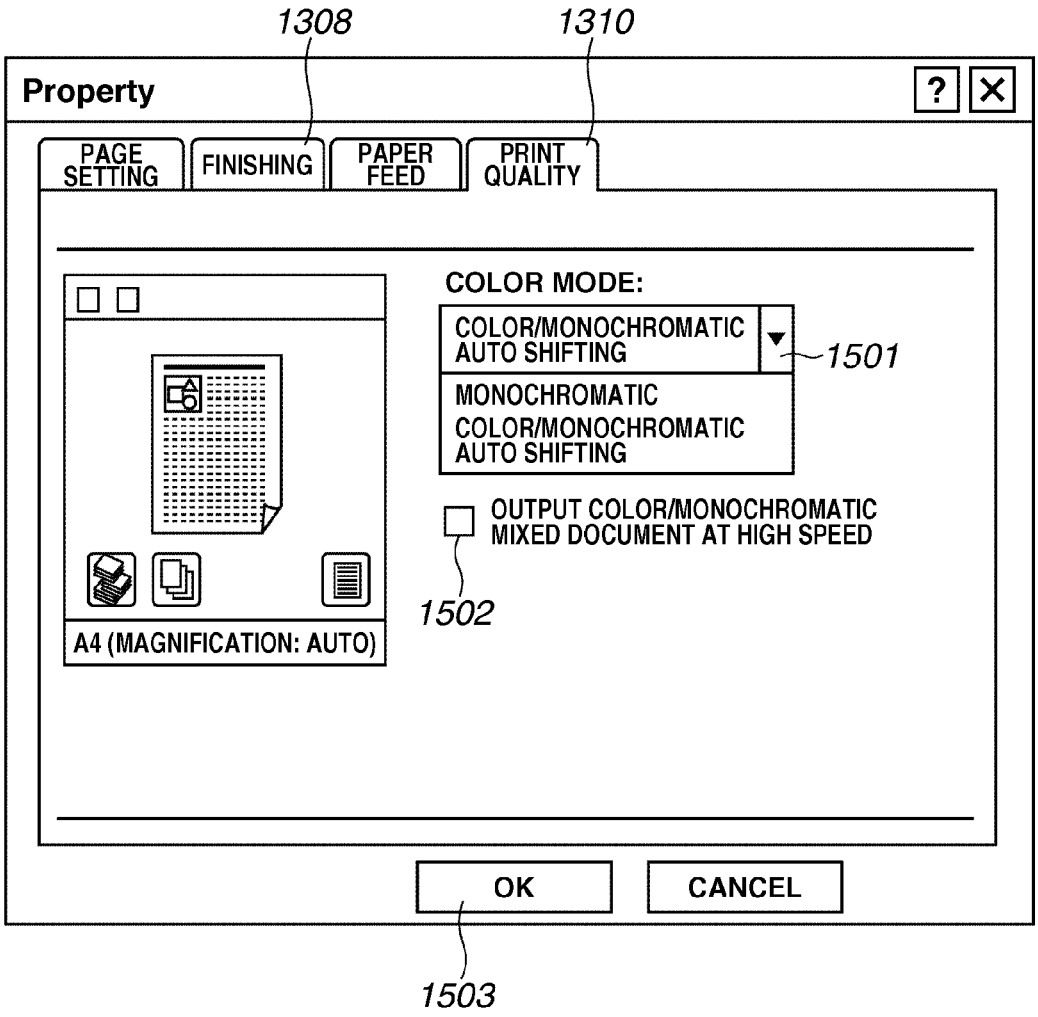
FIG. 15 illustrates an example of a screen displayed when an operator of the external apparatus presses a print quality tab via the printer driver setting screen according to the exemplary embodiment of the present invention.

FIG. 15 illustrates a screen displayed when the operator selects a print quality tab 1310 via the printer driver property setting screen illustrated in FIG. 13.

The operator of the external apparatus operates a color mode selection box 1501 using the pointing device (not shown). With this operation, the printer driver selects the print mode used in print-processing of the print job created according to the application data, in the printing apparatus 100.

For the print modes, a black and white (monochromatic) mode and a color/monochromatic auto shifting mode are provided.

When the operator selects the color/monochromatic auto shifting mode, a check box 1502 becomes active to be selected. The command for selecting the auto color selection mode according to the first exemplary embodiment is generated when the operator checks the check box 1502.

On the other hand, if the operator does not check the check box 1502, a command for selecting the print mode depending on whether a first page of the print job is color image data or monochromatic image data, is generated. More specifically, in this case, if the first page of the print job is color image data, a command is generated that the full color mode according to the first exemplary embodiment should be selected as the print mode.

On the other hand, if the first page of the print job is monochromatic image data, a command is generated that the monochromatic mode according to the first exemplary embodiment should be generated as the print mode.

When the settings via the printer driver property setting screens illustrated in FIG. 13, FIG. 14, and FIG. 15 are finished (that is, when the operator presses the OK button 1305, the OK button 1402, and the OK button 1503), the screen returns to the printer driver setting screen illustrated in FIG. 12.

When the OK button 1206 in the printer driver setting screen in FIG. 12 is pressed by the operator, the external apparatus combines settings made via the property setting screen with the application data, to generate one print job. Furthermore, the external apparatus sends the print job to the printing apparatus 100.

Figure 16:
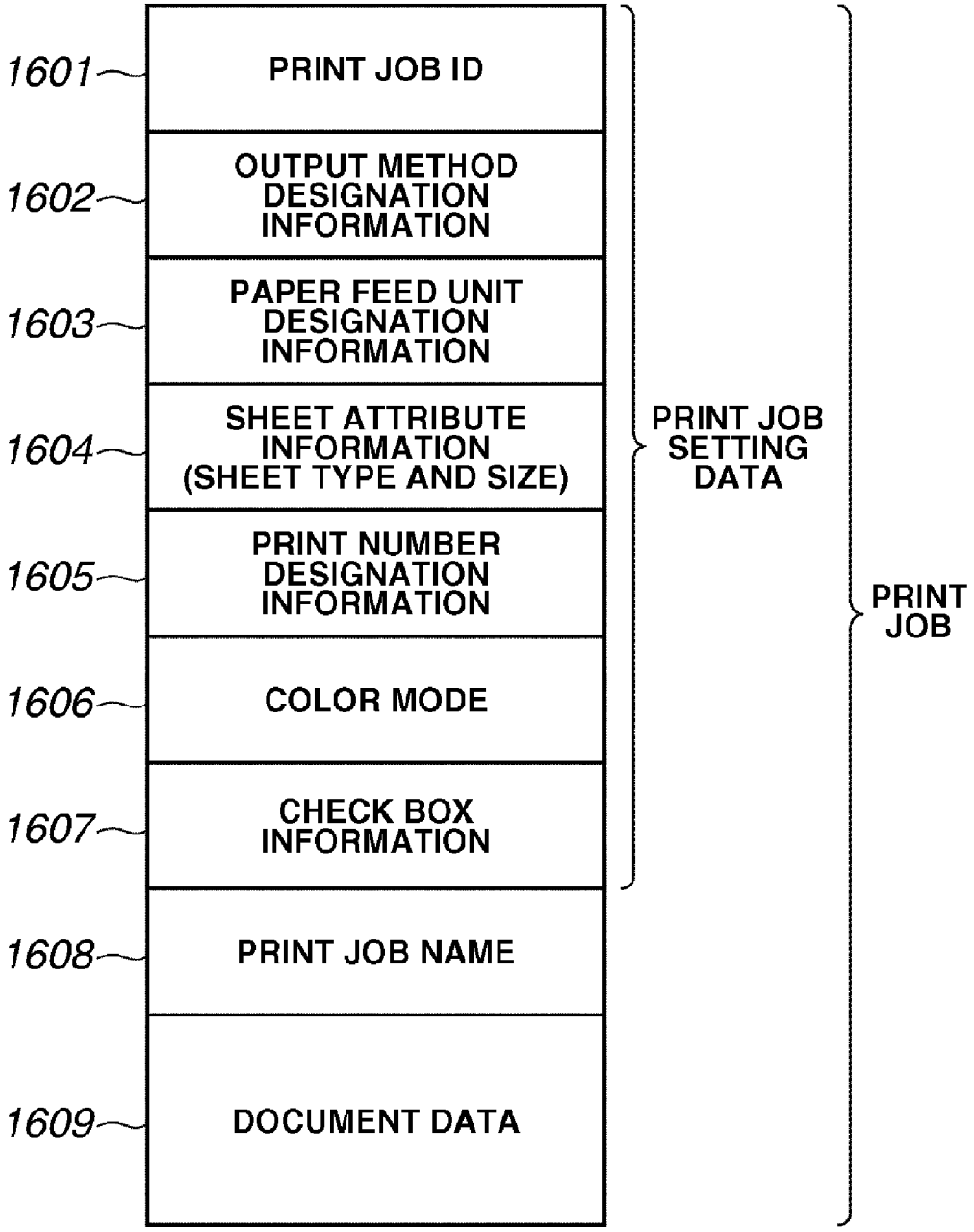
FIG. 16 illustrates a data configuration of a print job sent by the external apparatus to the printing apparatus according to the exemplary embodiment of the present invention.

A specific example of a data configuration of the print job is illustrated in FIG. 16.

FIG. 16 illustrates an exemplary data configuration of the print job sent by the external apparatus to the printing apparatus 100.

Referring to FIG. 16, a print job identification (ID) 1601 is a unique ID provided to the pint job so that the print job can be identified when the external apparatus sends the print job to the printing apparatus 100. Output method designation information 1602 is used for identifying the print method selected via the print method selection box 1401.

Paper feed unit designation information 1603 is used for identifying a paper feed unit selected via a paper feed unit selection box (not shown). Sheet attribute information 1604 includes sheet size information for identifying an output paper size selected via the output paper size selection box 1302.

Print number designation information 1605 is used for identifying the print number entered by the operator via the print number setting box 1204 or the print number selection box 1303 (the same value is entered in each of the boxes). Color mode information 1606 indicates a color mode selected via the color mode selection box 1501.

Check box information 1607 indicates whether the check box 1502 is checked. Print job name 1608 includes text data indicating a file name that is used by an application as a print job name to manage the print job.

Document data 1609 includes data of the document created by the application software operating on the external apparatus.

Now, processing for selecting the print mode in the printing apparatus 100 is described below with reference to FIG. 17.

Figure 17:
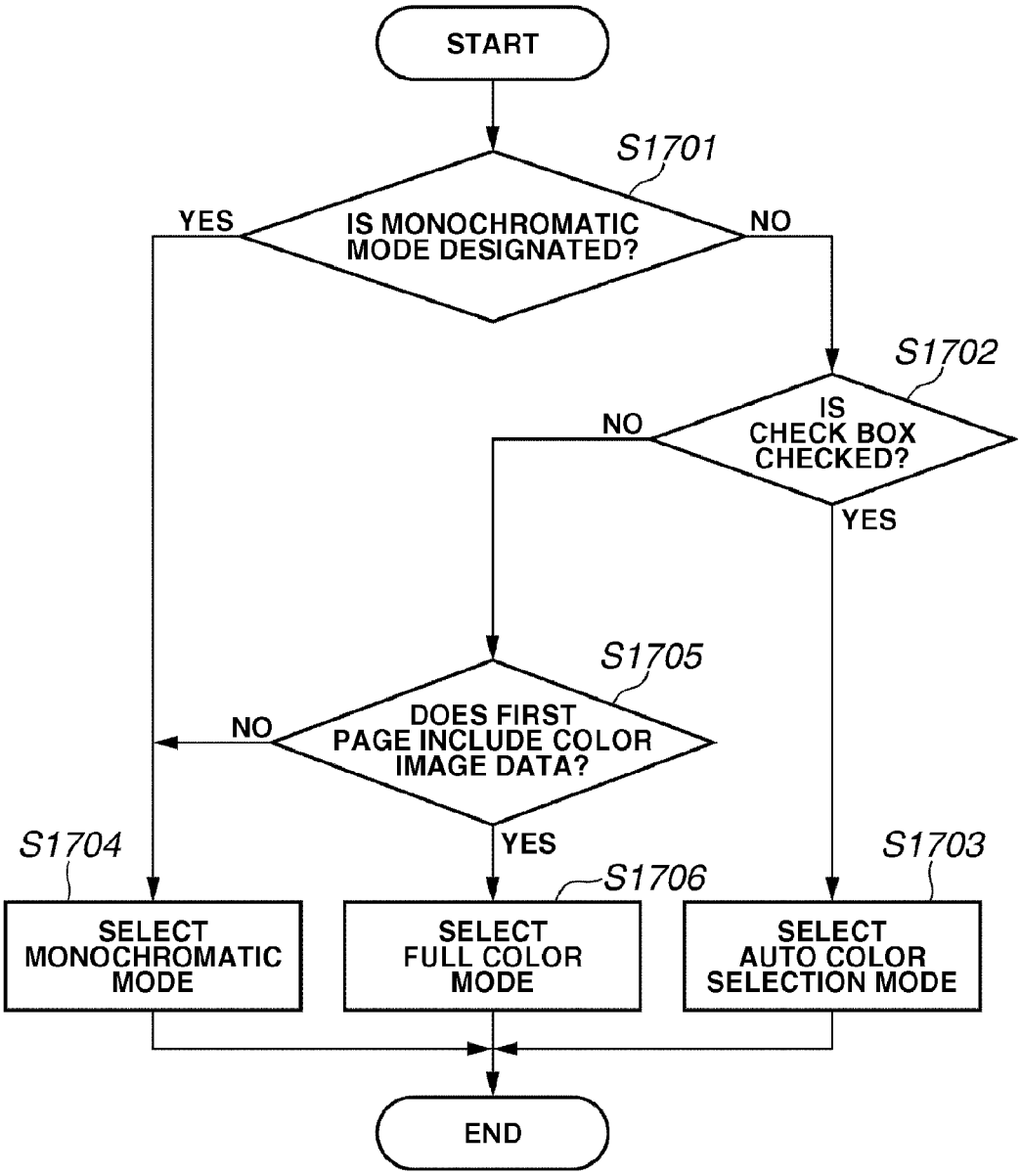
FIG. 17 is a flow chart illustrating print mode selection by the printing apparatus according to the exemplary embodiment of the present invention.

The processing illustrated in FIG. 17 is performed by the CPU 205 when the printing apparatus 100 receives the print job from the external apparatus via the external I/F 202.

Referring to FIG. 17, in step S1701, the CPU 205 determines whether the color mode designated for the print job is the monochromatic mode. If it is determined that the color mode designated to the print job is the monochromatic mode (Yes in step S1701), then the CPU 205 advances to step S1704. On the other hand, if it is determined that the color mode designated to the print job is not the monochromatic mode (No in step S1701), then the CPU 205 advances to step S1702.

In step S1704, the CPU 205 selects the monochromatic mode as the print mode, then ends the processing.

In step S1702, the CPU 205 refers to the check box information 1607 about the print job. In step S1702, the CPU 205 determines whether the check box 1502 is checked via the printer driver. If it is determined that the check box 1502 is checked via the printer driver (Yes in step S1702), then the CPU 205 advances to step S1703. On the other hand, if it is determined that the check box 1502 is not checked via the printer driver (No in step S1702), then the CPU 205 advances to step S1705.

In step S1703, the CPU 205 selects the auto color selection mode as the print mode.

In step S1705, the CPU 205 refers to the document data 1609 of the print job to determine whether image data of a first page of the print job is color image data or monochromatic image data. If it is determined that the image data of a first page of the print job is color image data (Yes in step S1705), then the CPU 205 advances to step S1706. On the other hand, if it is determined that the image data of a first page of the print job is not color image data (No in step S1705), then the CPU 205 advances to step S1704.

In step S1706, the CPU 205 selects the full color mode as the print mode.

Then, after selecting the print mode according to the flow chart illustrated in FIG. 17, the CPU 205 performs processing illustrated in the flow chart in FIG. 5 according to the first exemplary embodiment. Specific operations performed according to the flow chart of FIG. 5 are similar to the first exemplary embodiment. Accordingly, a description thereof is not repeated here.

As described above, the first through the third exemplary embodiments of the present invention provide the printing apparatus and the printing method in which the processing for shifting to monochromatic printing to transfer the printing apparatus to the state where monochromatic printing can be performed, and the processing for shifting to color printing to transfer the printing apparatus to the state where color printing can be performed. The processing for shifting to monochromatic printing and the processing for shifting to color printing are appropriately performed before starting the print processing, according to the selected one mode among the plural print modes.

Furthermore, according to the third exemplary embodiment, even when a print job is input from the external apparatus, the processing for shifting to monochromatic printing or the processing for shifting to color printing can be appropriately performed.

Fourth Exemplary Embodiment

In the first and the second exemplary embodiments, the print job includes a plurality of image data input from the scanner unit 201 by reading an original document. In a fourth exemplary embodiment, the print job is received from an external apparatus connected to the printing apparatus 100 via the external I/F 202.

Also in the third exemplary embodiment, the print job is received from the external apparatus connected to the printing apparatus 100 via the external I/F 202. The third embodiment is different from the fourth embodiment in a method of selecting the color mode. Hereinbelow, only the different points from the third exemplary embodiment are described, and a description as to the other points similar to the first exemplary embodiment is not repeated here.

Figure 18:
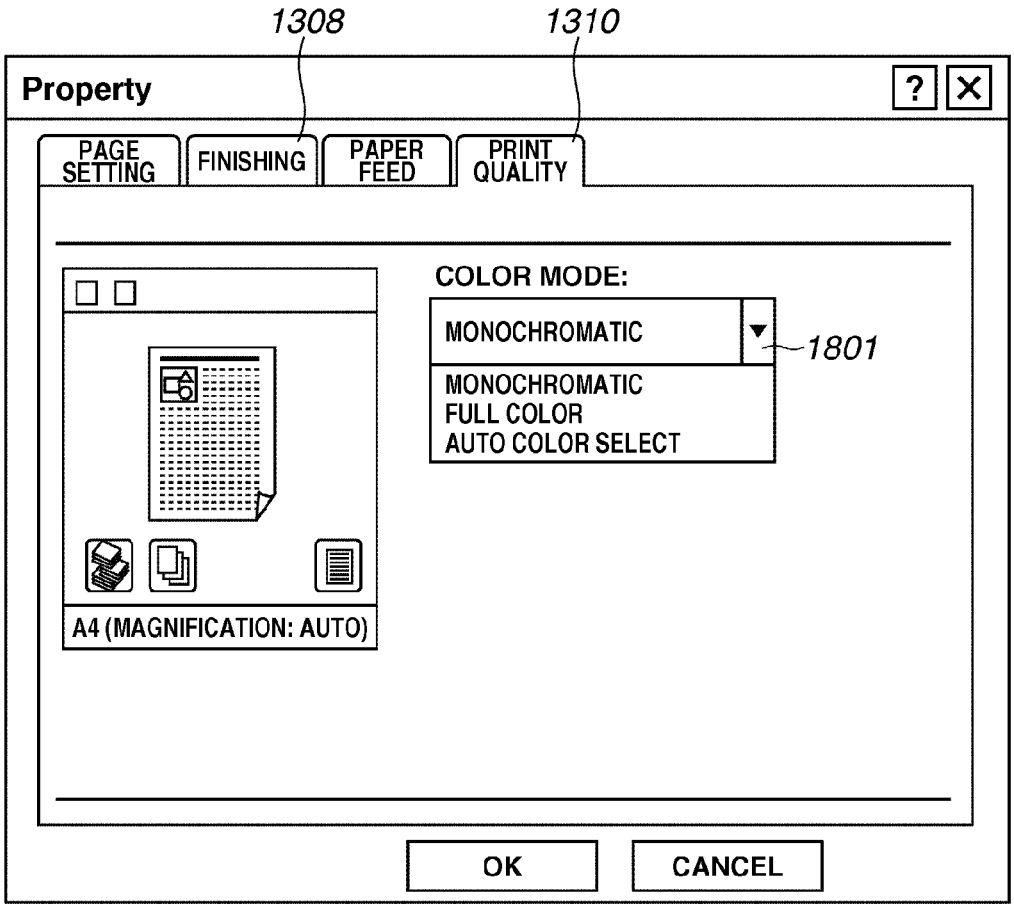
FIG. 18 illustrates an example of a screen displayed when an operator of the external apparatus presses the print quality tab via the printer driver setting screen according to the exemplary embodiment of the present invention.

FIG. 18 illustrates a screen displayed when the print quality tab 1310 is selected via the printer driver property setting screen illustrated in FIG. 13.

The operator of the external apparatus operates a color mode selection box 1801 using the pointing device (not shown). With this operation, the printer driver selects the print mode used in print-processing of the print job created according to the application data, in the printing apparatus 100.

As the print modes, a monochromatic mode and a color/monochromatic auto shifting mode are provided. The operation of the printing apparatus 100 in the three modes is similar to that described in the first exemplary embodiment.

When the settings via the printer driver property setting screens illustrated in FIG. 13, FIG. 14, and FIG. 15 are finished (that is, when the operator presses the OK button 1305, the OK button 1402, and the OK button 1503), the screen returns to the printer driver setting screen illustrated in FIG. 12.

When the OK button 1206 in the printer driver setting screen in FIG. 12 is pressed by the operator, the external apparatus combines setting made via the property setting screen with the application data, to generate one print job. Then, the external apparatus sends the print job to the printing apparatus 100.

The data configuration of the print job is similar to that described in the third exemplary embodiment with reference to FIG. 16.

While in the third exemplary embodiment, the check box information 1607 is provided, in the fourth exemplary embodiment, the check box information 1607 is not provided. Further, in the fourth exemplary embodiment, information for identifying which mode (i.e., the monochromatic mode, the full color mode, or the auto color selection mode) that is selected via the screen illustrated in FIG. 18, is added to the color mode information 1606.

When the CPU 205 of the printing apparatus 100 receives the print job via the external I/F 202, the CPU 205 analyzes the color mode information 1606 to determine the color mode designated to the print job.

Then, the CPU 205 performs the processing according to the flow chart of FIG. 5 based on the determined color mode.

Fifth Exemplary Embodiment

In the first exemplary embodiment, color image data can be input even when the monochromatic mode is selected, and when color image data is input, the CPU 205 performs the print mode shifting processing (step S513). In a fifth exemplary embodiment, color image data is not input in the monochromatic mode.

More specifically, in the first exemplary embodiment, the scanner unit 201 reads an original document as color image data. In the fifth exemplary embodiment, functions of the scanner unit 201 are similar to the first exemplary embodiment, but when the monochromatic mode is selected as the print mode, the scanner unit 201 operates differently from the first exemplary embodiment.

That is, when the monochromatic mode is selected as the print mode, the scanner unit 201 reads the original document not as color image data of three colors of RGB but as image data of a single color (for example, image data of "G" only). In this configuration, the CPU 205 always determines "Yes" in step S510 in FIG. 5.

Accordingly, in the monochromatic mode, the CPU 205 does not perform the print mode shifting processing (step S513) and always performs the print processing of all the pages in the print job at the conveyance speed of 200 mm/s.

The method of reading the original document using the scanner unit 201 is not limited to the method in which the scanner unit 201 reads an original document not as color image data of three colors of RGB, but as image data of a single color (for example, image data of "G" only). That is, for example, the color image data of three colors of RGB read using the scanner unit 201 can be converted into image data of a single color by the CPU 205 so that substantially color image data is not input.

Other Exemplary Embodiments

In the above-described exemplary embodiments, the sheet conveyance speed when the auto color selection mode is selected, is set to 150 mm/s, just as in the case of the full color mode. However, the sheet conveyance speed used in this case can be set differently. More specifically, the sheet conveyance speed can be arbitrarily set to be lower than the sheet conveyance speed in the monochromatic mode (200 mm/s).

In this regard, it is suitable to set the sheet conveyance speed sufficiently lower for print-processing color image data because in order to print-process color image data, the sheet conveyance speed needs to be appropriately low. For example, it is more suitable if the sheet conveyance speed in the auto color selection mode is substantially the same as the sheet conveyance speed in the full color mode.

In the above-described exemplary embodiments, the sheet conveyance speed is either 150 mm/s or 200 mm/s. However, a different speed can be used as long as the print processing is not affected thereby.

Furthermore, the present invention can also be achieved by providing a system or a device with a storage medium (or a recording medium) which stores program code of software implementing the functions of the embodiments and by reading and executing the program code stored in the storage medium with a computer of the system or the device (a CPU or an MPU). In this case, the program code itself, which is read from the storage medium, implements the functions of the embodiments mentioned above, and accordingly, the storage medium storing the program code constitutes the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A printing apparatus comprising:

a printing unit configured to perform print processing on a sheet based on image data;

a selection unit configured to select between a first print mode and a second print mode, the first print mode being for conveying a sheet at a first speed and performing monochromatic print processing for all pages, and the second print mode being for conveying a sheet at a second speed lower than the first speed regardless of whether each page included in the image data is monochromatic image data or color image data and performing monochromatic print processing for a page of the monochromatic image data and performing color print processing for a page of the color image data;

a control unit configured to control the printing unit to perform print processing in the print mode selected by the selection unit; and a performance unit configured to perform a first shifting process which is for shifting the printing unit to a state that the monochromatic print processing can be performed and a second shifting process which is for shifting the printing unit to a state that the color print processing can be performed, wherein in a case where the selection unit selects the first print mode, the performance unit performs the first shifting process to start the print processing, and wherein in a case where the selection unit selects the second print mode, the performance unit performs the first shifting process to start the print processing and further performs the second shifting process when a page of color image data is printed.

2. The printing apparatus according to claim 1, wherein the selection unit selects the print mode based on a user's instruction input via an operation unit of the printing apparatus.

3. The printing apparatus according to claim 1, further comprising a determining unit configured to determine whether the image data is monochromatic image data or color image data.

4. A printing apparatus comprising:

a printing unit configured to perform print processing on a sheet based on image data;

a selection unit configured to select between a first print mode and a second print mode, the first print mode being for, in a case where a first page to a (N−1)th page included in the image data are monochromatic image data and a Nth page is color image data, conveying the sheet at a first speed when printing for the first page to the (N−1)th page is performed, conveying the sheet at a second speed lower than the first speed when printing for the Nth page is performed, and conveying the sheet at the second speed when printing for a (N+1)th page to the end page is performed regardless of whether the page to be printed is the monochromatic image data or the color image data, and the second print mode being for conveying, for each page, the sheet at the second speed regardless of whether the page to be printed is the monochromatic image data or the color image data;

a speed changing unit configured to, in a case where the first print mode is selected by the selection unit, change a conveying speed of the sheet from the first speed to the second speed when printing of the Nth page is performed;

a control unit configured to control the printing unit to perform print processing in the print mode selected by the selection unit; and a performance unit configured to perform a first shifting process which is for shifting the printing unit to a state that a monochromatic print processing can be performed, a second shifting process which is for shifting the printing unit to a state that a color print processing can be performed, and a third shifting process which is for shifting the printing unit to a state that both of the monochromatic print processing and the color print processing can be performed, wherein in a case where the selection unit selects the first print mode, the performance unit performs the first shifting process when printing of the first page is performed and then performs the second shifting process when printing of the Nth page is performed, and wherein in a case where the selection unit selects the second print mode, the performance unit performs the third shifting process when printing of the first page is performed.

5. The printing apparatus according to claim 4, wherein the speed changing unit changes a conveying speed of a sheet from the first speed to the second speed after a sheet in processing by the printing apparatus is discharged to the outside of the printing apparatus.

6. The printing apparatus according to claim 4, wherein the selection unit selects the print mode based on a user's instruction input via an operation unit of the printing apparatus.

7. The printing apparatus according to claim 4, further comprising a determining unit configured to determine whether the image data is monochromatic image data or color image data.

8. A control method for a printing apparatus comprising a printing unit configured to perform print processing on a sheet based on image data, the method comprising:

selecting between a first print mode and a second print mode, the first print mode being for conveying a sheet at a first speed and performing monochromatic print processing for all pages, and the second print mode being for conveying a sheet at a second speed lower than the first speed regardless of whether each page included in the image data is monochromatic image data or color image data and performing monochromatic print processing for a page of the monochromatic image data and performing color print processing for a page of the color image data;

controlling the printing unit to perform print processing in the selected print mode; and performing a first shifting process which is for shifting the printing unit to a state that the monochromatic print processing can be performed, a second shifting process which is for shifting the printing unit to a state that the color print processing can be performed, wherein in a case where the first print mode is selected, performing comprises performing the first shifting process to start the print processing, and wherein in a case where the second print mode is selected, performing comprises performing the first shifting process to start the print processing and further performing the second shifting process when a page of color image data is printed.

9. A computer-readable storage medium storing a program for causing a computer to execute the control method of the printing apparatus according to claim 8.

10. A control method for a printing apparatus comprising a printing unit configured to perform print processing on a sheet based on image data, the method comprising:

selecting between a first print mode and a second print mode, the first print mode being for, in a case where a first page to a (N−1)th page included in the image data are monochromatic image data and a Nth page is color image data, conveying the sheet at a first speed when printing for the first page to the (N−1)th page is performed, conveying the sheet at a second speed lower than the first speed when printing for the Nth page is performed, and conveying the sheet at the second speed when printing for a (N+1)th page to the end page is performed regardless of whether the page to be printed is the monochromatic image data or the color image data, and the second print mode being for conveying, for each page, the sheet at the second speed regardless of whether the page to be printed is the monochromatic image data or the color image data;

changing, in a case where the first print mode is selected, a conveying speed of the sheet from the first speed to the second speed when printing of the Nth page is performed;

controlling the printing unit to perform print processing in the selected print mode; and performing a first shifting process which is for shifting the printing unit to a state that a monochromatic print processing can be performed, a second shifting process which is for shifting the printing unit to a state that a color print processing can be performed, and a third shifting process which is for shifting the printing unit to a state that both of the monochromatic print processing and the color print processing can be performed, wherein in a case where the first print mode is selected, performing comprises performing the first shifting process when printing of the first page is performed and then performs the second shifting process when printing of the Nth page is performed, and wherein in a case where the second print mode is selected, performing comprises performing the third shifting process when printing of the first page is performed.

11. A computer-readable storage medium storing a program for causing a computer to execute the control method of the printing apparatus according to claim 10.

12. A printing apparatus comprising:

a printing unit configured to perform print processing on a sheet based on image data;

a selection unit configured to select between a first print mode and a second print mode, the first print mode being for, in a case where a first page to a (N−1)th page included in the image data are monochromatic image data and a Nth page is color image data, conveying the sheet at a first speed when printing for the first page to the (N−1)th page is performed, conveying the sheet at a second speed lower than the first speed when printing for the Nth page is performed, and conveying the sheet at the second speed when printing for a (N+1)th page to the end page is performed regardless of whether the page to be printed is the monochromatic image data or the color image data, and the second print mode being for conveying, for each page, the sheet at the second speed regardless of whether the page to be printed is the monochromatic image data or the color image data;

a speed changing unit configured to, in a case where the first print mode is selected by the selection unit, change a conveying speed of the sheet from the first speed to the second speed when printing of the Nth page is performed; and a control unit configured to control the printing unit to perform print processing in the print mode selected by the selection unit, wherein the speed changing unit changes the conveying speed of a sheet from the first speed to the second speed after a sheet in processing by the printing apparatus is discharged to the outside of the printing apparatus.

13. The printing apparatus according to claim 12, wherein the selection unit selects the print mode based on a user's instruction input via an operation unit of the printing apparatus.

14. The printing apparatus according to claim 12, further comprising a determining unit configured to determine whether the image data is monochromatic image data or color image data.

15. A method for a printing apparatus comprising:

performing print processing on a sheet based on image data;

selecting between a first print mode and a second print mode, the first print mode being for, in a case where a first page to a (N−1)th page included in the image data are monochromatic image data and a Nth page is color image data, conveying the sheet at a first speed when printing for the first page to the (N−1)th page is performed, conveying the sheet at a second speed lower than the first speed when printing for the Nth page is performed, and conveying the sheet at the second speed when printing for a (N+1)th page to the end page is performed regardless of whether the page to be printed is the monochromatic image data or the color image data, and the second print mode being for conveying, for each page, the sheet at the second speed regardless of whether the page to be printed is the monochromatic image data or the color image data;

in a case where the first print mode is selected by the selection unit, changing a conveying speed of the sheet from the first speed to the second speed when printing of the Nth page is performed; and controlling to perform print processing in the print mode, wherein changing a conveying speed comprises changing the conveying speed of a sheet from the first speed to the second speed after a sheet in processing by the printing apparatus is discharged to the outside of the printing apparatus.

16. A computer-readable storage medium storing a program for causing a computer to execute the control method of the printing apparatus according to claim 15.

* * * * *